US011759804B2

(12) United States Patent
Ophardt et al.

(10) Patent No.: US 11,759,804 B2
(45) Date of Patent: Sep. 19, 2023

(54) TWO STAGE FOAM PUMP AND METHOD OF PRODUCING FOAM

(71) Applicant: OP-Hygiene IP GmbH, Niederbipp (CH)

(72) Inventors: Heiner Ophardt, Arisdorf (CH); Andrew Jones, St. Anns (CA)

(73) Assignee: OP-HYGIENE IP GMBH, Niederbipp (CH)

( * ) Notice: Subject to any disclaimer, the term of this patent is extended or adjusted under 35 U.S.C. 154(b) by 0 days.

(21) Appl. No.: 17/481,861

(22) Filed: Sep. 22, 2021

(65) Prior Publication Data

US 2022/0008941 A1 Jan. 13, 2022

Related U.S. Application Data

(63) Continuation of application No. 16/367,620, filed on Mar. 28, 2019, now Pat. No. 11,161,127.

(60) Provisional application No. 62/649,732, filed on Mar. 29, 2018.

(30) Foreign Application Priority Data

Sep. 24, 2018 (CA) ..... CA 3018299

(51) Int. Cl.

| | |
|---|---|
| ***B05B 7/00*** | (2006.01) |
| ***A47K 5/16*** | (2006.01) |
| ***B05B 11/00*** | (2023.01) |
| ***B01F 23/235*** | (2022.01) |
| ***B05B 11/10*** | (2023.01) |

(52) U.S. Cl.

CPC ..... *B05B 7/0018* (2013.01); *A47K 5/16* (2013.01); *B01F 23/235* (2022.01); *B05B 7/0037* (2013.01); *B05B 11/0044* (2018.08); *B05B 11/0064* (2013.01); *B05B 11/1087* (2023.01); *B05B 11/1047* (2023.01); *B05B 11/1074* (2023.01)

(58) Field of Classification Search

CPC . B05B 7/0018; B05B 7/0037; B05B 11/0044; B05B 11/0064; B05B 11/3087; B05B 11/3047; B05B 11/3074; B05B 7/0491; A47K 5/16; B01F 23/235

See application file for complete search history.

(56) References Cited

U.S. PATENT DOCUMENTS 6,644,516 B1 * 11/2003 Foster ..... G01F 11/028 222/321.9
11,161,127 B2 * 11/2021 Ophardt ..... B05B 7/0491
2006/0273114 A1 * 12/2006 Ophardt ..... B05B 11/3087 222/207

(Continued)

FOREIGN PATENT DOCUMENTS

CN 103623961 A * 3/2014 ..... B05B 11/3001
WO WO-2013170445 A1 * 11/2013 ..... B05B 11/3025

*Primary Examiner* — Bob Zadeh

(74) *Attorney, Agent, or Firm* — Thorpe North & Western, LLP; Peter M. de Jonge; Kurt Hendricks

(57) ABSTRACT

A foam dispenser with a pump mechanism that mixes a liquid with air to generate foam. The pump mechanism includes a first stage pump and a second stage pump. The first stage pump delivers the liquid and a first volume of the air through a first foam generator to generate a first foam. The second stage pump delivers the first foam and a second volume of the air through a second foam generator to generate a second foam.

20 Claims, 12 Drawing Sheets

(56) References Cited

U.S. PATENT DOCUMENTS

| | | | | |
|---|---|---|---|---|
| 2012/0080539 | A1* | 4/2012 | Wang | B05B 11/3087 239/289 |
| 2014/0034679 | A1* | 2/2014 | Fitzpatrick | A47K 5/16 222/137 |
| 2015/0208855 | A1* | 7/2015 | Jenkins | B01F 23/2351 426/115 |
| 2015/0209811 | A1* | 7/2015 | Ophardt | B05B 11/3087 222/190 |
| 2022/0008941 | A1* | 1/2022 | Ophardt | A47K 5/16 |

* cited by examiner

TWO STAGE FOAM PUMP AND METHOD OF PRODUCING FOAM

RELATED APPLICATION

This application is a continuation of co-pending U.S. patent application Ser. No. 16/367,620 filed Mar. 28, 2019 and claims the benefit of 35 U.S.C. 120.

SCOPE OF THE INVENTION

This invention relates to a pump for producing a foam of a liquid and air, and to a method of providing a foamed liquid.

BACKGROUND OF THE INVENTION

Foam pumps are known in which a liquid and air are simultaneously passed through a foam generator to produce a discharge of foamed air and liquid.

The inventors of the present application have appreciated that the ability to produce advantageous foam from liquids is a complicated matter, and the particular nature of the liquid, foaming components within the liquid, as well as various other conditions arising during the foaming process can lead to considerably different qualities of foam being produced.

The present inventors have appreciated that with some liquids, the ability to produce foam is affected by the pressure in which the air and liquid are directed into the foam generator.

SUMMARY OF THE INVENTION

To at least partially overcome some of the disadvantages of previously known devices and methods, the present inventors have provided a foam dispenser that generates foam in two stages. In a first stage, a liquid and a first volume of air are passed through a first foam generator to generate a first foam. In a second stage, the first foam and a second volume of air are passed through a second foam generator to generate a second foam.

The inventors have appreciated that, in at least some embodiments of the invention, the quality of the foam can be improved by generating the foam in two stages. For example, for some liquids it may be advantageous to commence the foaming process in the first stage with a particular ratio of liquid-to-air, type of foam generator, and/or fluid pressure, and then to complete the foaming process in the second stage with a different ratio of liquid-to-air, type of foam generator, and/or fluid pressure. The conditions of the first stage may be selected, for example, to initiate foaming, and the conditions of the second stage may be selected, for example, to improve the quality and/or volume of the foam.

The inventors have also appreciated that, in at least some embodiments of the invention, better quality foam can be produced by passing the air and the liquid through the foam generator at an elevated pressure that is greater than atmospheric pressure, and preferably at least 0.5 bar above atmospheric pressure.

The inventors have further appreciated that the elevated pressure can be usefully generated by the foam dispenser itself when activated. For example, in some embodiments of the invention, the dispenser includes a compressible chamber for delivering the air and the liquid to the foam generator. When the dispenser is activated, the volume of the compressible chamber is reduced by, for example, an instroke or outstroke movement of a piston. This reduction in volume causes an increase in pressure within the chamber.

Optionally, the dispenser includes a high pressure valve that regulates the flow of the air and the liquid through the foam generator. The high pressure valve is configured to prevent the air and the liquid from flowing out of the compressible chamber and through the foam generator until the pressure within the chamber reaches a preselected threshold pressure. The valve thus allows the pressure within the chamber to rise up to at least the preselected threshold pressure before the air and the liquid are passed through the foam generator.

The inventors have also appreciated that, in at least some embodiments of the invention, the quality of the foam can be improved by generating the foam in two stages at different pressures. In the first stage, the air and the liquid are passed through the foam generator at an elevated pressure that is greater than atmospheric pressure, and preferably at least 0.5 bar above atmospheric pressure, to generate the first foam. The first foam is then passed through the second foam generator, together with the second volume of air, to generate the second foam in the second stage. The pressure at which the first foam and the second volume of air are passed through the second foam generator in the second stage can differ from, and is preferably lower than, the pressure at which the air and the liquid are passed through the first foam generator in the first stage.

In some embodiments, passing the air and the liquid through the first foam generator at an elevated pressure may help to commence the foaming process. Passing the resulting foam through the second foam generator at a reduced pressure less than the elevated pressure, together with an additional volume of air, may furthermore help to increase the volume and/or quality of the foam.

Further aspects of the invention include:

1. A foam dispenser comprising:

a pump mechanism that mixes a liquid with air to generate foam, the pump mechanism comprising:

a first stage pump that delivers the liquid and a first volume of the air through a first foam generator to generate a first foam; and a second stage pump that delivers the first foam and a second volume of the air through a second foam generator to generate a second foam.

2. A foam dispenser, optionally including one or more features of 1, wherein the first stage pump comprises a flow restrictor that restricts a flow of the liquid and the first volume of the air through the first foam generator.

3. A foam dispenser, optionally including one or more features of 1 or 2, wherein the flow restrictor comprises a high pressure valve that regulates fluid flow through the first foam generator; and wherein the high pressure valve prevents fluid from flowing past the high pressure valve unless the fluid is at or above a threshold pressure.

4. A foam dispenser, optionally including one or more features of 1 to 3, wherein the first stage pump pressurizes the liquid and the first volume of the air up to at least the threshold pressure when the pump mechanism is activated.

5. A foam dispenser, optionally including one or more features of 1 to 4, wherein the first stage pump further comprises a variable volume high pressure compartment that receives at least one of the liquid and the air; and wherein the pump mechanism reduces a volume of the high pressure compartment from a first volume to a smaller second volume when activated, thereby increasing a pressure within the high pressure compartment to the threshold pressure.

6. A foam dispenser, optionally including one or more features of 1 to 5, wherein the high pressure valve is positioned between the high pressure compartment and the first foam generator.

7. A foam dispenser, optionally including one or more features of 1 to 6, wherein the first stage pump further comprises a high pressure passageway that fluidly connects the high pressure valve to the first foam generator; and wherein the high pressure passageway delivers the liquid and the first volume of the air to the first foam generator at an elevated pressure that is greater than atmospheric pressure when at least one of the liquid and the air is received from the high pressure valve at the threshold pressure.

8. A foam dispenser, optionally including one or more features of 1 to 7, wherein the high pressure passageway receives the liquid and the first volume of the air through the high pressure valve from the high pressure compartment.

9. A foam dispenser, optionally including one or more features of 1 to 8, wherein the high pressure passageway has a volume that is selected so that an internal pressure within the high pressure passageway rises to the elevated pressure when the liquid and the air are received from the high pressure valve at the threshold pressure.

10. A foam dispenser, optionally including one or more features of 1 to 9, wherein the second stage pump comprises a second variable volume compartment for receiving the first foam from the first foam generator, and delivering the first foam and the second volume of the air through the second foam generator to generate the second foam.

11. A foam dispenser, optionally including one or more features of 1 to 10, wherein the second foam generator comprises a porous member for generating turbulence when the air and the first foam pass simultaneously through the porous member.

12. A foam dispenser, optionally including one or more features of 1 to 11, wherein the second compartment delivers the first foam and the second volume of the air to the second foam generator at a reduced pressure that is lower than the elevated pressure.

13. A foam dispenser, optionally including one or more features of 1 to 12, wherein the pump mechanism reduces a volume of the second compartment from an expanded volume to a reduced volume when activated, thereby delivering the first foam and the second volume of the air through the second foam generator.

14. A foam dispenser, optionally including one or more features of 1 to 13, wherein the pump mechanism draws the liquid from an unpressurized liquid reservoir, draws the air from an unpressurized air source, and discharges the second foam from a discharge outlet when activated.

15. A foam dispenser, optionally including one or more features of 1 to 14, wherein the pump mechanism comprises a piston chamber forming body and a piston forming element that is coaxially slidable along an axis relative to the piston chamber forming body between a retracted position and an extended position in a cycle of operation.

16. A foam dispenser, optionally including one or more features of 1 to 15, wherein the piston chamber forming body comprises:

a liquid inlet for drawing the liquid from the liquid reservoir; and a liquid compartment forming wall defining, at least in part, a variable volume liquid compartment in fluid communication with the liquid inlet;

the pump mechanism further comprising a one-way liquid inlet valve positioned between the liquid compartment and the liquid reservoir, the one-way liquid inlet valve permitting the liquid to flow from the liquid inlet into the liquid compartment, and preventing the liquid from flowing from the liquid compartment out the liquid inlet.

17. A foam dispenser, optionally including one or more features of 1 to 16, wherein the piston forming element comprises a liquid pumping piston that slides coaxially within the piston chamber forming body radially adjacent to the liquid compartment forming wall;

the liquid pumping piston having a one-way liquid receiving valve that is positioned between the liquid compartment and the high pressure compartment, the one-way liquid receiving valve permitting the liquid to flow from the liquid compartment to the high pressure compartment, and preventing the liquid and the air from flowing from the high pressure compartment to the liquid compartment;

wherein the liquid compartment is defined at least between the liquid pumping piston, the liquid compartment forming wall, and the one-way liquid inlet valve;

wherein, in the cycle of operation, the liquid pumping piston reciprocally slides between the retracted position and the extended position, which causes a volume of the liquid compartment to cycle between an enlarged volume and a contracted volume;

wherein an expansion of the volume of the liquid compartment from the contracted volume to the enlarged volume creates a vacuum within the liquid compartment, which draws the liquid from the liquid reservoir into the liquid compartment through the liquid inlet and the one-way liquid inlet valve; and wherein a contraction of the volume of the liquid compartment from the enlarged volume to the contracted volume increases a fluid pressure within the liquid compartment, which forces the liquid to flow from the liquid compartment into the high pressure compartment through the one-way liquid receiving valve.

18. A foam dispenser, optionally including one or more features of 1 to 17, wherein the piston chamber forming body further comprises a high pressure compartment forming wall;

wherein the piston forming element comprises a high pressure pumping piston that slides coaxially within the piston chamber forming body radially adjacent to the high pressure compartment forming wall;

wherein the high pressure compartment is defined at least between the high pressure pumping piston, the high pressure compartment forming wall, and the one-way liquid receiving valve;

wherein, in the cycle of operation, the high pressure pumping piston reciprocally slides between the retracted position and the extended position, which causes the volume of the high pressure compartment to cycle between the first volume and the second volume;

the pump mechanism further comprising a one-way air receiving valve that is positioned between the high pressure compartment and a first air source, the one-way air receiving valve allowing the air to flow through the one-way air receiving valve from the first air source into the high pressure compartment, and preventing the liquid and the air from flowing through the one-way air receiving valve from the high pressure compartment to the first air source;

wherein an expansion of the volume of the high pressure compartment from the second volume to the first volume creates a vacuum within the high pressure compartment, which draws the air from the first air source into the high pressure compartment through the one-way air receiving valve; and wherein a contraction of the volume of the high pressure compartment from the first volume to the second volume increases the pressure within the high pressure compartment until the threshold pressure is reached, at which point the high pressure valve opens and the liquid and the air contained within the high pressure compartment flow from the high pressure compartment into the high pressure passageway and through the first foam generator at the elevated pressure to generate the first foam.

19. A foam dispenser, optionally including one or more features of 1 to 18, wherein the piston forming element further comprises a high pressure passageway forming wall; and wherein the high pressure passageway is defined at least between the high pressure valve, the high pressure passageway forming wall, and the first foam generator.

20. A foam dispenser, optionally including one or more features of 1 to 19, wherein the piston chamber forming body further comprises a low pressure compartment forming wall;

wherein the piston forming element comprises a low pressure pumping piston that slides coaxially within the piston chamber forming body radially adjacent to the low pressure compartment forming wall;

wherein the second compartment is defined at least between the low pressure pumping piston, the low pressure compartment forming wall, and the first foam generator;

wherein, in the cycle of operation, the low pressure pumping piston reciprocally slides between the retracted position and the extended position, which causes the volume of the second compartment to cycle between the expanded volume and the reduced volume;

wherein an expansion of the volume of the second compartment from the reduced volume to the expanded volume creates a vacuum within the second compartment, which draws the second volume of the air from a second air source into the second compartment; and wherein a contraction of the volume of the second compartment from the expanded volume to the reduced volume increases the pressure within the second compartment, which forces the first foam and the second volume of the air contained within the second compartment through the second foam generator to generate the second foam.

21. A foam dispenser, optionally including one or more features of 1 to 20, wherein pump mechanism draws the second volume of the air into the second compartment through at least one of: a second one-way air receiving valve and the discharge outlet.

22. A foam dispenser, optionally including one or more features of 1 to 21, wherein the first air source comprises at least one of: the second compartment and an external environment surrounding the foam dispenser.

23. A foam dispenser, optionally including one or more features of 1 to 22, wherein the second air source comprises at least one of: an internal air reservoir and the external environment surrounding the foam dispenser.

24. A foam dispenser, optionally including one or more features of 1 to 23, wherein the piston forming element moves coaxially relative to the piston chamber forming body from the extended position to the retracted position in an instroke movement and from the retracted position to the extended position in an outstroke movement in the cycle of operation;

wherein the volume of the liquid compartment expands from the contracted volume to the enlarged volume during a first movement selected from the instroke movement and the outstroke movement; and wherein the volume of the liquid compartment contracts from the enlarged volume to the contracted volume during a second movement that differs from the first movement and is selected from the instroke movement and the outstroke movement.

25. A foam dispenser, optionally including one or more features of 1 to 24, wherein the volume of the high pressure compartment expands from the second volume to the first volume during the first movement; and wherein the volume of the high pressure compartment contracts from the first volume to the second volume during the second movement.

26. A foam dispenser, optionally including one or more features of 1 to 25, wherein the volume of the second compartment expands from the reduced volume to the expanded volume during the first movement; and wherein the volume of the second compartment contracts from the expanded volume to the reduced volume during the second movement.

27. A foam dispenser, optionally including one or more features of 1 to 26, wherein the volume of the high pressure compartment expands from the second volume to the first volume during the second movement; and wherein the volume of the high pressure compartment contracts from the first volume to the second volume during the first movement.

28. A foam dispenser, optionally including one or more features of 1 to 27, wherein the volume of the second compartment expands from the reduced volume to the expanded volume during the second movement; and wherein the volume of the second compartment contracts from the expanded volume to the reduced volume during the first movement.

29. A foam dispenser, optionally including one or more features of 1 to 28, wherein the first movement is the instroke movement and the second movement is the outstroke movement.

30. A foam dispenser, optionally including one or more features of 1 to 29, wherein the first movement is the outstroke movement and the second movement is the instroke movement.

31. A foam dispenser, optionally including one or more features of 1 to 30, wherein the first movement precedes the second movement in the cycle of operation, or the second movement precedes the first movement in the cycle of operation.

32. A foam dispenser, optionally including one or more features of 1 to 31, wherein the first stage pump delivers the liquid and the first volume of the air to the first foam generator at a first pressure; and wherein the second stage pump delivers the first foam and the second volume of the air to the second foam generator at a second pressure that is lower than the first pressure.

33. A foam dispenser, optionally including one or more features of 1 to 32, wherein the first pressure is at least 0.5 bar above atmospheric pressure.

34. A foam dispenser, optionally including one or more features of 1 to 33, wherein the first pressure is at least 1.0 bar above atmospheric pressure.

35. A foam dispenser, optionally including one or more features of 1 to 34, wherein the first pressure is at least 1.5 bar above atmospheric pressure.

36. A foam dispenser, optionally including one or more features of 1 to 35, wherein the first pressure is at least 1.1 atm above atmospheric pressure.

37. A foam dispenser, optionally including one or more features of 1 to 36, wherein the first pressure is no greater than 3.0 atm above atmospheric pressure.

38. A foam dispenser, optionally including one or more features of 1 to 37, wherein the threshold pressure is at least 0.5 bar above atmospheric pressure.

39. A foam dispenser, optionally including one or more features of 1 to 38, wherein the threshold pressure is at least 1.0 bar above atmospheric pressure.

40. A foam dispenser, optionally including one or more features of 1 to 39, wherein the threshold pressure is at least 1.5 bar above atmospheric pressure.

41. A foam dispenser, optionally including one or more features of 1 to 40, wherein the pump mechanism is manually activated.

42. A foam dispenser, optionally including one or more features of 1 to 41, wherein the high pressure valve comprises a one-way valve.

43. A foam dispenser, optionally including one or more features of 1 to 42, wherein the first foam generator comprises a screen.

44. A foam dispenser, optionally including one or more features of 1 to 43, wherein the liquid comprises a foamable hand cleaning liquid.

45. A method of generating foam, optionally including one or more features of 1 to 44, comprising:

delivering a liquid and a first volume of air through a first foam generator to generate a first foam; and delivering the first foam and a second volume of air through a second foam generator to generate a second foam.

46. A method, optionally including one or more features of 1 to 45, wherein the first foam and the second foam are generated by the foam dispenser of any one of 1 to 44.

47. A method of operating a dispenser to discharge a foamed mixture of a hand cleaning liquid and air, optionally including one or more features of 1 to 46, comprising:

passing a stream of liquid and a first stream of air simultaneously through a one-way valve and then into a first foam generator to produce a first foamed stream comprising the stream of liquid and the first stream of air, and passing the first foamed stream and a second stream of air simultaneously through a second foam generator to produce a second foamed stream that is discharged to the atmosphere, providing the one-way valve is to prevent flow therethrough unless the pressure differential across the one-way valve is greater than at least one atmosphere.

48. A method of operating a dispenser to produce a foamed mixture of a hand cleaning liquid and air, optionally including one or more features of 1 to 47, comprising:

mixing a stream of the liquid and a first stream of air to provide a first mixture, providing the mixture at a first pressure of at least 0.5 atmosphere above atmospheric pressure to a first foam generator to thereby pass the mixture through the first foam generator to produce a first foamed stream comprising the stream of liquid and the first stream of air, and passing the first foamed stream and a second stream of air simultaneously through a second foam generator to produce a second foamed stream that is discharged from the second foam generator at atmospheric pressure.

49. A method, optionally including one or more features of 1 to 48, wherein the first pressure is in the range of 0.5 to 2.5 atmosphere above atmospheric pressure.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
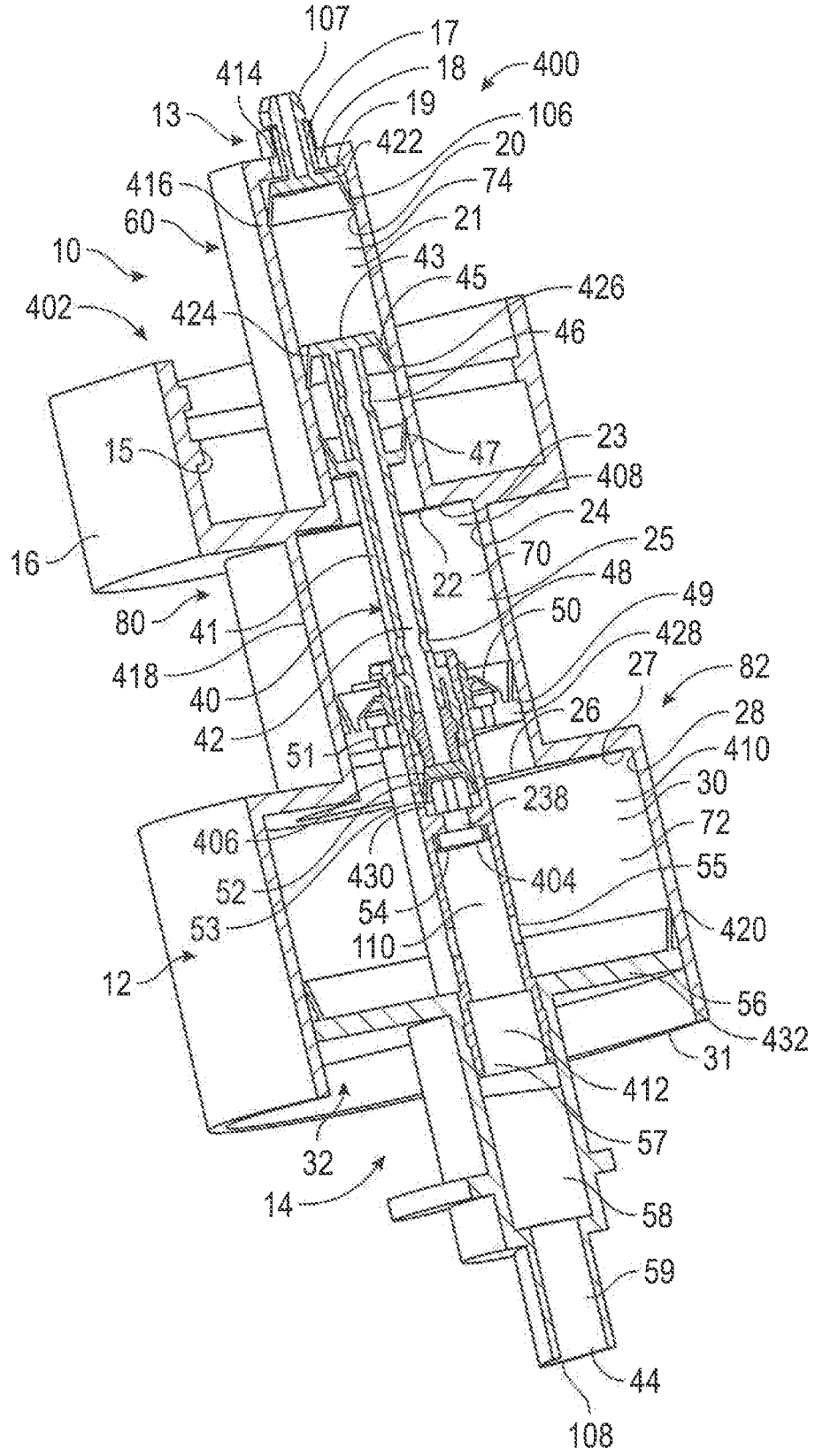
FIG. 1 is a front cross-sectional pictorial view of a pump in accordance with a first embodiment of the present invention.
Figure 2:
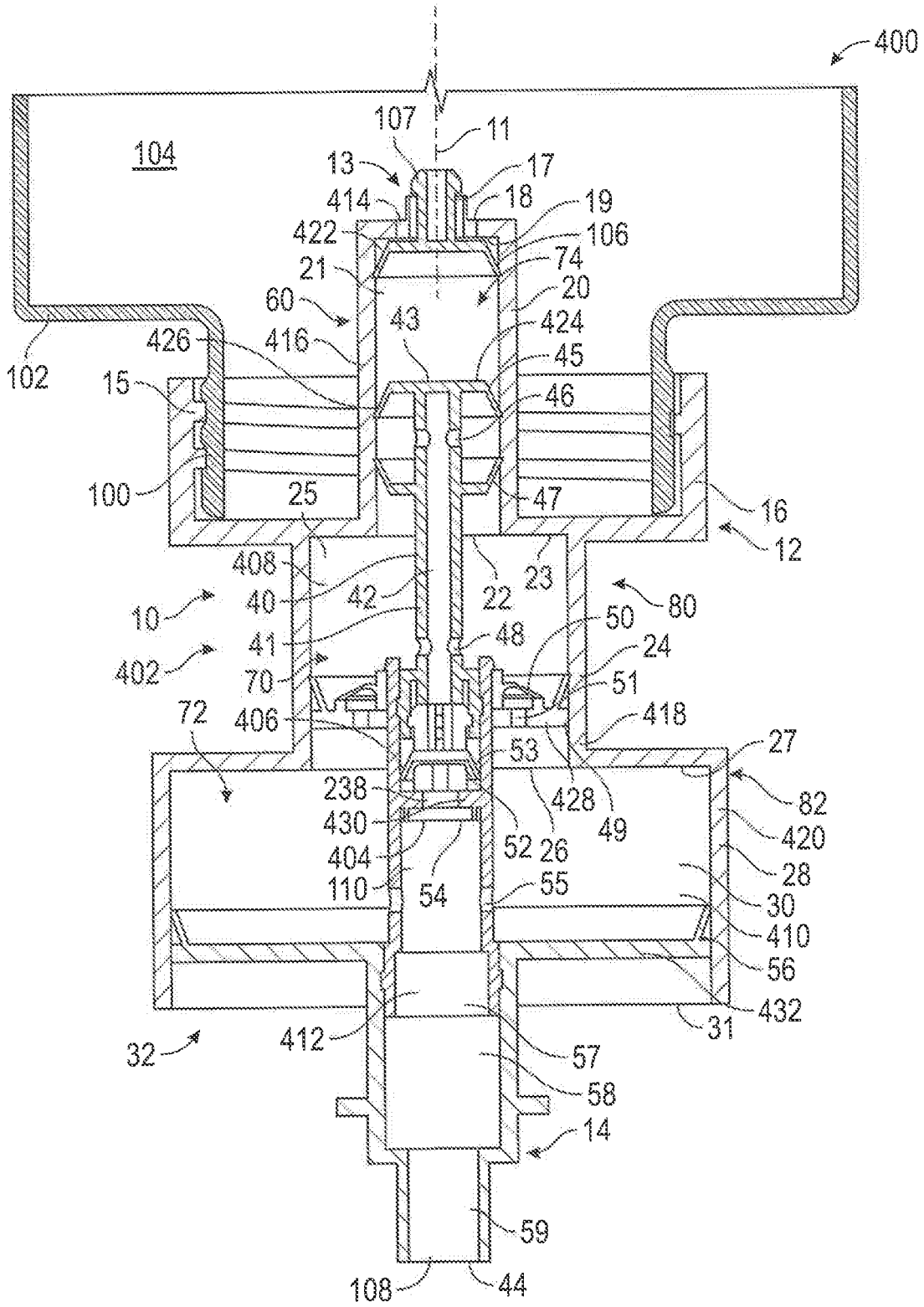
FIG. 2 is a front cross-sectional view of the pump of FIG. 1 with a piston-forming element in an extended position.
Figure 3:
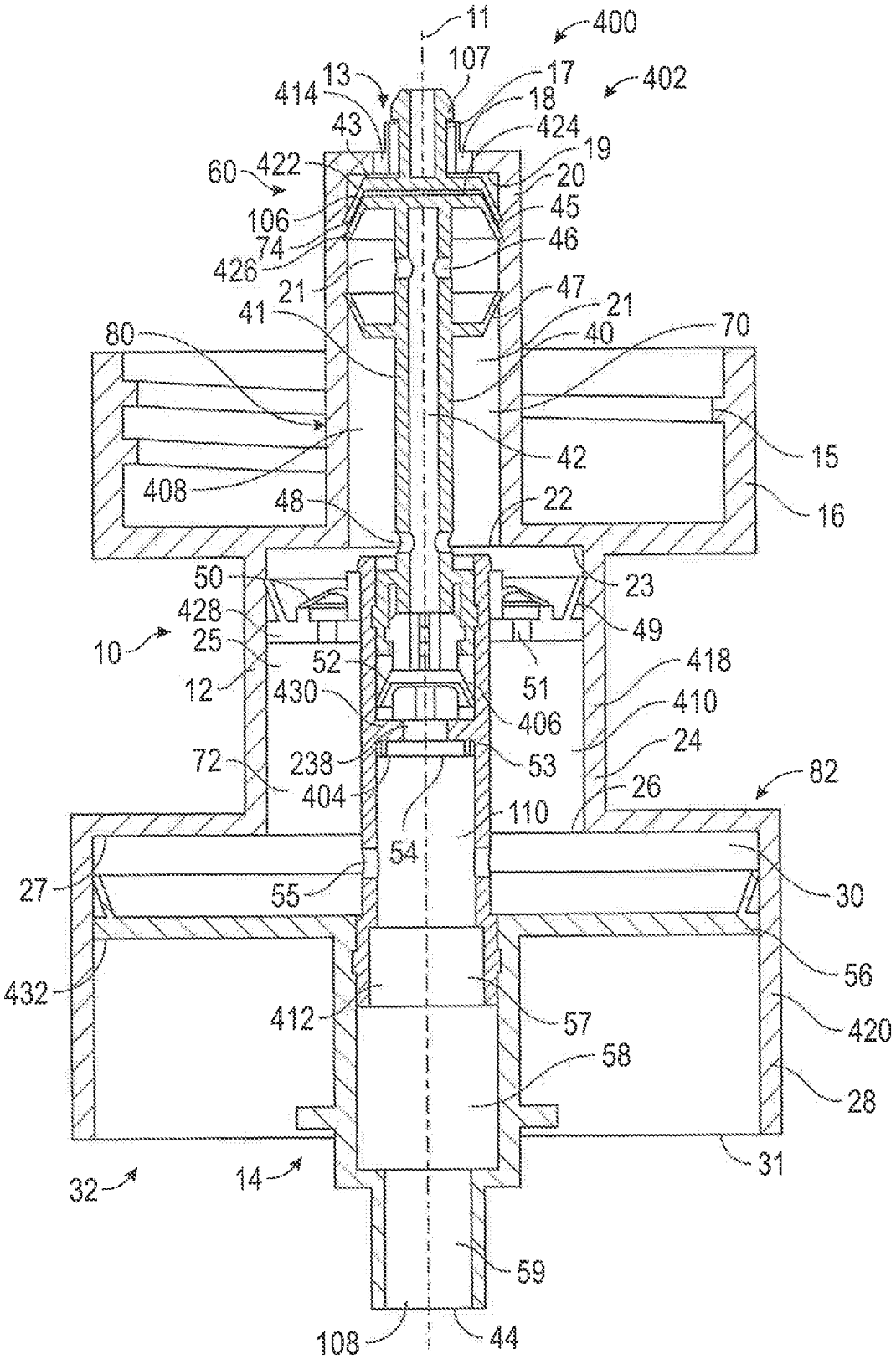
FIG. 3 is a front cross-sectional view the same as FIG. 2 but with the piston-forming element in a retracted position.

FIGS. 1 to 3 illustrate a first embodiment of a pump 10 in accordance with the present invention. The pump 10 functions as a foam dispenser 400 for dispensing foam. The pump 10 comprises three principal elements, namely, a piston chamber-forming body 12, a one-way valve 13 and a piston-forming element 14. Together, the piston chamber-forming body 12, the one-way valve 13, and the piston-forming element 14 form a pump mechanism 402 for generating and dispensing the foam.

The piston chamber-forming body 12 in the preferred embodiment is formed by injection molding as a unitary element, although this is not necessary. The piston chamber-forming body 12 is disposed coaxially about a center axis 11 and provides three chambers, namely, an inner chamber 21, an intermediate chamber 25 and an outer chamber 30. The inner chamber 21 is defined within a cylindrical wall 20 coaxial about the axis 11 between an inner end 19 of the inner chamber 21 and an open outer end 22 of the inner chamber 21. The inner end 19 of the inner chamber 21 is closed but for a central opening 17 and a number of passage openings 18 that function as a liquid inlet 414. The inner chamber 21 opens axially outwardly at its open outer end 22 into the axially inner end 23 of the intermediate chamber 25. Intermediate chamber 25 is defined within a cylindrical wall 24 coaxial about the axis 11 extending from the inner end 23 of the intermediate chamber 25 and open axially at the outer end 26 of the intermediate chamber 25. The open outer end 26 of the intermediate chamber 25 opens into the axially inner end 27 of the outer chamber 30. The outer chamber 30 is defined within a cylindrical wall 28 coaxial about the axis 11. The outer chamber 30 extends from the inner end 27 to an open axially outer end 31.

The piston chamber-forming body 12 carries a threaded collar 16 coaxial about the axis 11 carrying radially inwardly directed threads 15. The collar 16 and the threads 15 are adapted to sealably engage with a threaded neck 100 of a reservoir 102 containing a liquid 104 to be dispensed as shown merely in FIG. 2. The reservoir 102 is preferably unpressurized, and carries the liquid 104 at or around atmospheric pressure.

The one-way valve 13 carries a valve disc 106 at one end of a tubular stem 107. The stem 107 is received in a friction-fit within the central opening 17 in the inner end 19 of the inner chamber 21 of the piston chamber-forming body 12 to securely locate the valve disc 106 coaxially within the inner end 19 of the chamber 21. The valve disc 106 extends radially outwardly to a distal end in sealing engagement with the cylindrical wall 20 of the inner chamber 21. The valve disc 106 engages the cylindrical wall 20 of the inner chamber 21 to prevent fluid flow axially inwardly therepast. However, the valve disc 106 deflects to permit fluid flow axially outwardly therepast from the reservoir 102 through the openings 18 and into the inner chamber 21. Flow from the inner chamber 21 to the reservoir 102 is prevented by the one-way valve 13. The one-way valve 13 thus functions as a one-way liquid inlet valve 422.

The inner chamber 21, intermediate chamber 25, and outer chamber 30 together form a chamber cavity 32. The piston-forming element 14 is coaxially slidably received within the chamber cavity 32 of the piston chamber-forming body 12. The piston-forming element 14 includes a central stem 40 coaxial about the axis 11. A central passageway 42 is provided within the stem 40 closed at an axial inner end 43 and open at an axially outer end 44 providing a discharge outlet or opening 108 for discharge of air and liquid as foam. A number of disc members extend radially outwardly from the stem 40.

Near the inner end 43 of the stem 40, a valve disc 45 extends radially outward from the stem 40 into engagement with the cylindrical wall 20 of the inner chamber 21. The valve disc 45 engages the cylindrical wall 20 to prevent fluid flow axially inwardly therepast. The valve disc 45 is resiliently deflectable and deflects radially inwardly from the cylindrical wall 20 to permit fluid flow axially outwardly therepast. The valve disc 45 thus serves as a one-way liquid receiving valve 426. A seal disc 47 is provided on the stem 40 axially outwardly from the valve disc 45. The seal disc 47 extends radially outwardly from the stem 40 to engage the cylindrical wall 20 and prevents fluid flow axially outwardly therepast. On the stem 40, in between the valve disc 45 and the seal disc 47, inner ports 46 are provided providing communication through the cylindrical wall 41 of the stem 40 into the central passageway 42.

The combination of the one-way valve 13, the inner chamber 21, and the stem 40, including the valve disc 45, the inner ports 46, and the seal disc 47 provides a liquid pump 60 which with reciprocal movement of the piston-forming element 14 and the piston chamber-forming body 12 draws liquid 104 from the reservoir 102 and discharges the liquid 104 outwardly through the central passageway 42 axially outwardly from the inner ports 46 in a manner analogous to that described in U.S. Pat. No. 5,975,360 to Ophardt, issued Nov. 2, 1999, the disclosure of which is incorporated herein by reference. The valve disc 45 functions as a liquid pumping body or piston 424.

As can be seen in FIGS. 2 and 3, respectively, during operation of the pump 10, the valve disc 45 and the seal disc 47 are maintained with movement between an extended position and a retracted position within the inner chamber 21.

Axially outwardly from the inner seal disc 47, an intermediate seal disc 49 is provided extending radially outwardly from the stem 40 and into engagement with the cylindrical wall 24 of the intermediate chamber 25, with the intermediate seal disc 49 engaging the cylindrical wall 24 to prevent fluid flow axially outwardly therepast. Between the inner seal disc 47 and the intermediate seal disc 49, intermediate ports 48 are provided through the cylindrical wall 41 of the stem 40 providing communication into the central passageway 42. The intermediate seal disc 49 has a number of passage openings 51 annularly spaced thereabout providing communication from an axially inner side of the intermediate seal disc 49 to an axially outer side of the intermediate seal disc 49. Secured to the stem 40 is a one-way air receiving valve or inlet valve 50 that closes the passage openings 51 to fluid flow axially outwardly therethrough but is deflectable to permit fluid flow axially inwardly therepast by which fluid may flow axially inwardly past the intermediate seal disc 49 through the passage openings 51. Within the central passageway 42 axially outwardly of the intermediate ports 48, a diaphragm check valve or one-way exit valve 52 is provided. The one-way exit valve 52 includes a valve disc 53 which engages an inner surface of the cylindrical wall 41 of the stem 40 to prevent fluid flow axially inwardly therepast and with the valve disc 53 deflecting radially inwardly to provide for fluid flow within the central passageway 42 axially outwardly past the valve disc 53. The one-way exit valve 52 thus provides for fluid flow axially outwardly within the central passageway 42 yet prevents fluid flow axially inwardly. Axially outwardly of the one-way exit valve 52, a first foam generator 404 in the form of a screen 54 is provided extending across the central passageway 42. Axially outwardly of the screen 54, outer ports 55 are provided through the cylindrical wall 41 of the stem 40 to provide for flow into the central passageway 42. Axially outwardly of the intermediate seal disc 49 and axially outwardly of the outer ports 55 an outer seal disc 56 is provided extending radially outwardly from the stem 40 into engagement with the cylindrical wall 28 of the outer chamber 30. The outer seal disc 56 engages the cylindrical wall 28 of the outer chamber 30 to prevent fluid flow outwardly therepast. Within the central passageway 42 axially outwardly of the outer ports 55, a second foam generator 412 in the form of a porous foaming sponge or plug 57 is provided across the passageway 42. Axially outwardly from the foaming plug 57, a foaming chamber 58 is provided within the central passageway 42 open to a discharge tube portion 59 of the central passageway 42 that opens to the discharge opening 108. Axially outwardly from the screen 54, a first foam chamber 110 is provided.

Within the inner chamber 21 and the intermediate chamber 25, between the inner seal disc 47 and the intermediate seal disc 49, a variable volume first air compartment 70 is defined, which functions as a compressible high pressure chamber or compartment 408. Within the intermediate chamber 25 and the outer chamber 30, between the intermediate seal disc 49 and the outer seal disc 56, a variable volume second air compartment 72 is defined, which functions as a low pressure chamber or compartment 410. The outer seal disc 56 functions as a low pressure pumping body or piston 432. Within the inner chamber 21, intermediate the valve disc 106 of the one-way valve 13 and the inner seal disc 47 on the piston-forming element 14, a variable volume liquid compartment or liquid chamber 74 is defined. The cylindrical wall 20 of the inner chamber 21 thus serves as a liquid chamber forming wall 416; the cylindrical wall 24 of the intermediate chamber 25 serves as a high pressure chamber forming wall 418; and the cylindrical wall 28 of the outer chamber 30 serves as a low pressure chamber forming wall 420.

The pump 10 defines a first stage air pump or high pressure pump 80 between the piston chamber-forming body 12 and the piston-forming element 14 within the inner chamber 21 and the intermediate chamber 25 between the inner seal disc 47 and the intermediate seal disc 49. The intermediate seal disc 49 serves as a high pressure pumping body or piston 428. With the diameter of the inner chamber 21 less than the diameter of the intermediate chamber 25, in a retraction stroke, on movement from the extended position of FIG. 2 to the retracted position of FIG. 3, the volume of the variable volume first air compartment 72 reduces forcing fluid within the first air compartment 70 from the first air compartment 70 through the intermediate ports 48 into the central passageway 42 and, hence, axially outwardly through the central passageway 42 past the one-way exit valve 52 and through the foam generator screen 54 into the first foam chamber 110. The portion of the central passageway 42 between the one-way exit valve 52 and the screen 54 thus serves as a high pressure passageway 238 for delivering fluid from the one-way exit valve 52 to the screen 54, and the portion of the cylindrical wall 41 of the stem 40 between the one-way exit valve 52 and the screen 54 serves as a high pressure passageway forming wall 430.

In a withdrawal stroke on moving from the retracted position of FIG. 3 to the extended position of FIG. 2, the volume of the first air compartment 70 increases drawing air into the first air compartment 70 from the second air compartment 58 through the passage openings 51 via the one-way inlet valve 50.

A low pressure pump or second stage air pump 82 is defined. With the diameter of the intermediate chamber 25 being less than the diameter of the outer chamber 30, on movement of the piston-forming element 14 within the piston chamber-forming body 12 from the extended position of FIG. 2 to the retracted position of FIG. 3, in a retraction stroke, the volume of the second air compartment 72 decreases forcing air from the second air compartment 72 through the outer ports 55 into the central passageway 42 and, hence, axially outwardly through the foam generator plug 57 into the foam chamber 58 through the discharge tube portion 59 and out the discharge outlet 108. In a withdrawal stroke, the volume of the second air compartment 72 increases drawing air into the second air compartment 72 via the discharge opening 108, the central passageway 42 and the outer ports 55.

In a retraction stroke, the liquid pump 60 discharges liquid from the reservoir 102 axially outwardly through the central passageway 42 from the inner ports 46, simultaneously with fluid within the first air compartment 70 being forced by the first stage air pump 80 through the intermediate ports 48. The liquid discharged by the liquid pump 60 and the air and/or some liquid discharged by the first stage air pump 80 are simultaneously discharged through the one-way exit valve 52 and, hence, through the first foam generator screen 54 to generate foam into the first foam chamber 110. As well, in a retraction stroke, simultaneously with the discharge of air, liquid and foam axially outwardly through the screen 54, the second stage air pump 82 forces air and any liquid within the second air compartment 72 through the outer ports 55 to mix with the liquid, air and foam discharged from the screen 54 for subsequent discharge axially outwardly through the foam generator plug 57 with air, liquid and primary foam being passed through the plug 57 to produce and discharge the same as secondary foam within the second foam chamber 58 from which the resultant second foam is discharged out the discharge opening 108.

In a withdrawal stroke, the volume of the variable volume liquid compartment 74 increases drawing liquid 104 from the reservoir 102 into the variable volume liquid compartment 74 by the liquid pump 60. In the withdrawal stroke, the first stage air pump 80 has its variable volume first air compartment 70 increase in volume drawing air from the second air compartment 72 axially inwardly through the passage openings 51 past the one-way inlet valve 50. In the withdrawal stroke, the second stage air pump 82 has its second air compartment 72 increase in volume drawing air from the atmosphere by the discharge opening 108 and any air, liquid and foam within the central passageway 42 axially outwardly of the ports 55 axially inwardly via the central passageway 42 to the ports 55 into the second air compartment 72.

In accordance with the present invention, the one-way exit valve 52 may be selected so as to vary the pressure that needs to be developed within the first air compartment 70 such that the first stage air pump 80 will discharge liquid and air axially outwardly within the central passageway 42 past the one-way exit valve 52. The one-way exit valve 52 may be selected having regard to the pressures that need to be present within the first air compartment 70 for the one-way exit valve 52 to permit liquid and air to pass axially outwardly therepast. These pressures may be selected having regard to various criteria.

In preferred configurations, the one-way exit valve 52 functions as a high pressure valve 406 requiring the pressure within the first air compartment 70 to rise to above 0.1 atmospheres above atmospheric pressure, preferably, above 0.2 or 0.3 or 0.4 or 0.5 or 0.6 or 0.7 or 0.8 or 0.9 or 1.0 or 1.1 or 1.2 or 1.3 or 1.4 or 1.5 or 1.6 or 1.7 or 1.8 or 1.9 or 2 atmospheres above atmospheric. Preferably, the pressure required to pass air and liquid past the one-way exit valve 52 is in the range of 0.2 to 2.5 atmospheres above atmospheric, or in ranges of 0.4 to 2.5 atmospheres or 0.5 to 2.5 atmospheres above atmospheric. Preferably, the pressure in the first air compartment 70 is not greater than about 2.0 or 2.5 or 3 atmospheres above atmospheric. The first embodiment provides for two stage foaming of the liquid 104 with a first stage of foaming arising by the simultaneous passage of a stream or volume of liquid 104 from the liquid pump 60 and a first stream or volume of air from the first stage air pump 80 through the first foam generator screen 54, and with a subsequent second foaming stage in which the foamed liquid and air passed through the first foam generator screen 54 is then mixed with an additional stream or volume of air from the second stage air pump 82 and together all forced through the secondary foam generator plug 57.

In accordance with the first preferred embodiment, the first foam generator 404 is shown as screen 54 and the second foam generator 412 is shown as a porous plug 57. Various other foam generators may be used as the first foam generator 404 or the second foam generator 412, with each generator comprising an arrangement that provides for turbulent passage of the air and liquid 104 as is known to produce foam. Each generator may comprise some combination of porous member, screen, intersecting passageways, static mixer, and the like. In some embodiments, the first foam generator 404 and/or the second foam generator 412 may comprise a Tesla-type valvular conduit such as described in United States Patent Application Publication No. 2017/0265691 to Ophardt et al., published Sep. 21, 2017, which is incorporated herein by reference.

Figure 4:
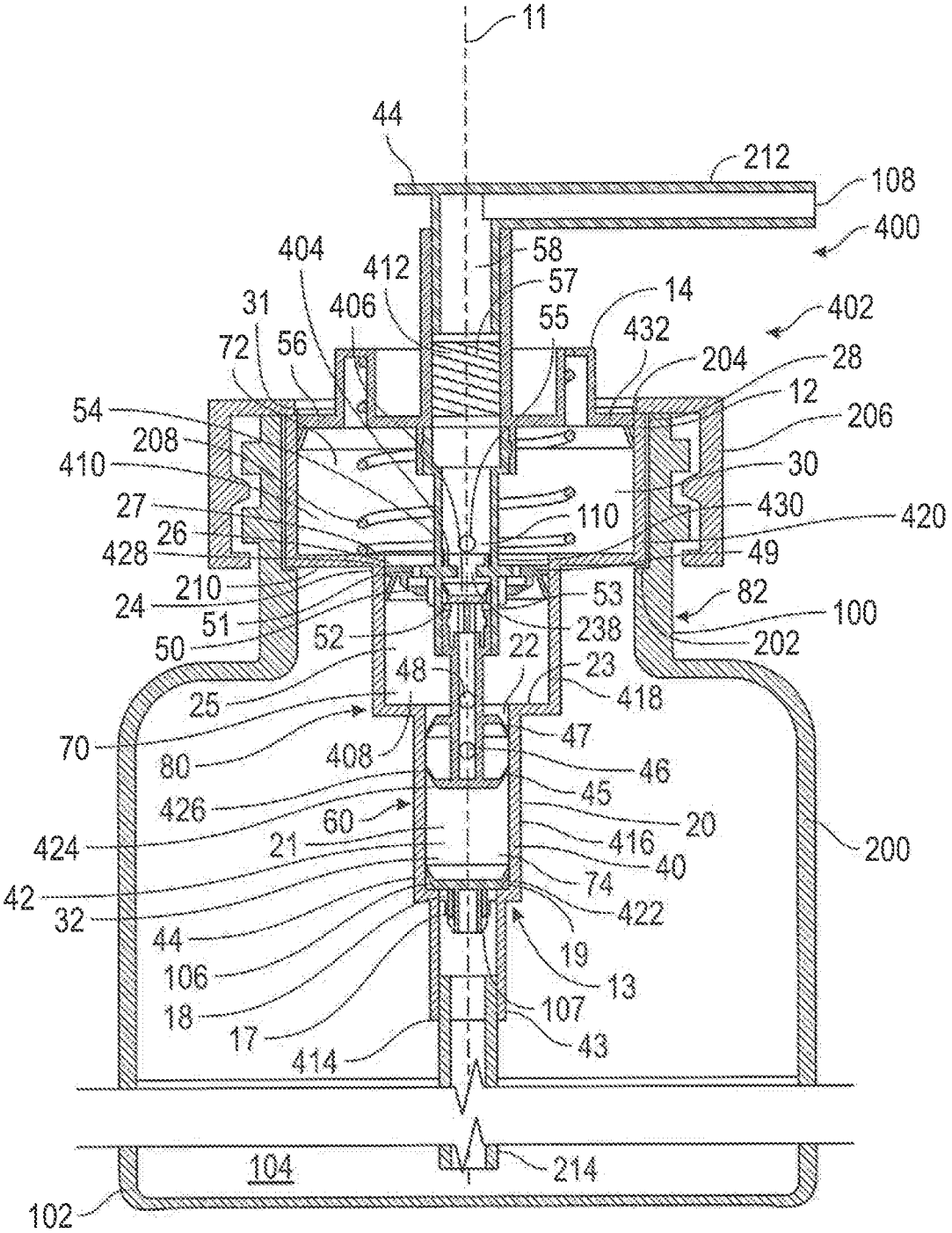
FIG. 4 is a cross-sectional side view of a pump in accordance with a second embodiment of the invention.

Reference is made to FIG. 4 which illustrates a second embodiment of a pump 10 in accordance with the present invention. Like numerals are used to denote like components. In the first embodiment, the pump 10 is preferably orientated so that flow outwardly through the central passageway 42 is generally downwardly, although this is not necessary. In accordance with the second embodiment, the pump 10 is configured to be secured within the neck 100 of an upwardly open bottle 200 containing the liquid 104. The piston chamber-forming body 12 is secured against axial movement in the neck 100 of the bottle 200 between an axially outwardly disposed shoulder 202 in the neck 100 of the bottle 200 and an axially inwardly directed annular surface 204 on a cap 206 threaded onto the neck 100 of the bottle 200. The surface on the cap 206 extends radially inwardly past the cylindrical wall 28 of the outer chamber 30 so as to engage the outer seal disc 56 and prevent the piston-forming element 14 from being removed from the chamber cavity 32. A coil spring 208 is provided between the outer seal disc 56 and a shoulder 210 forming the axially inner end 27 of the outer chamber 30 to bias the piston-forming element 14 axially outwardly relative to the piston-chamber forming body 12. Axially outwardly of the second foam generator 412, a discharge tube 212 is provided which extends radially of the axis 11 to the discharge opening 108.

As shown in FIG. 4, a dip tube 214 is provided at the axially inner end 43 of the stem 40 axially inwardly of the one-way valve 13, which dip tube 214 extends downwardly into liquid 104 at the bottom of the bottle 200. The elements and operation of the pump 10 in the second embodiment are generally the same as in the first embodiment. As one difference, the intermediate ports 48 are located to be lower relative to the intermediate chamber 25 and its inner end 23 and, similarly, the outer ports 55 are located to be lower and, as seen in FIG. 4, closer to the inner seal disc 47. Similarly, the outer ports 55 are shown to be lower and thus closer to the intermediate seal disc 49. The pump 10 may be operated to, for example, discharge foam from the discharge opening 108 onto a user's hand.

In the embodiment shown in FIG. 4, as well as the embodiment shown in FIGS. 1 to 3, each of the liquid pump 60, the first stage air pump 80, and the second stage air pump 82 are in phase. In other words, the liquid pump 60, the first stage air pump 80, and the second stage air pump 82 each expel fluid during the same piston stroke, in this case the retraction stroke, and draw fluid during the same piston stroke, in this case the withdrawal stroke. In other embodiments, the pumps 60, 80, 82 could each expel fluid during the withdrawal stroke and draw fluid during the retraction stroke. In other embodiments, the pumps 60, 80, 82 could also be out of phase, with one of the pumps 60, 80, 82 expelling fluid during the retraction stroke or the withdrawal stroke, and the other pumps 60, 80, 82 expelling fluid during the opposite stroke.

Figure 5:
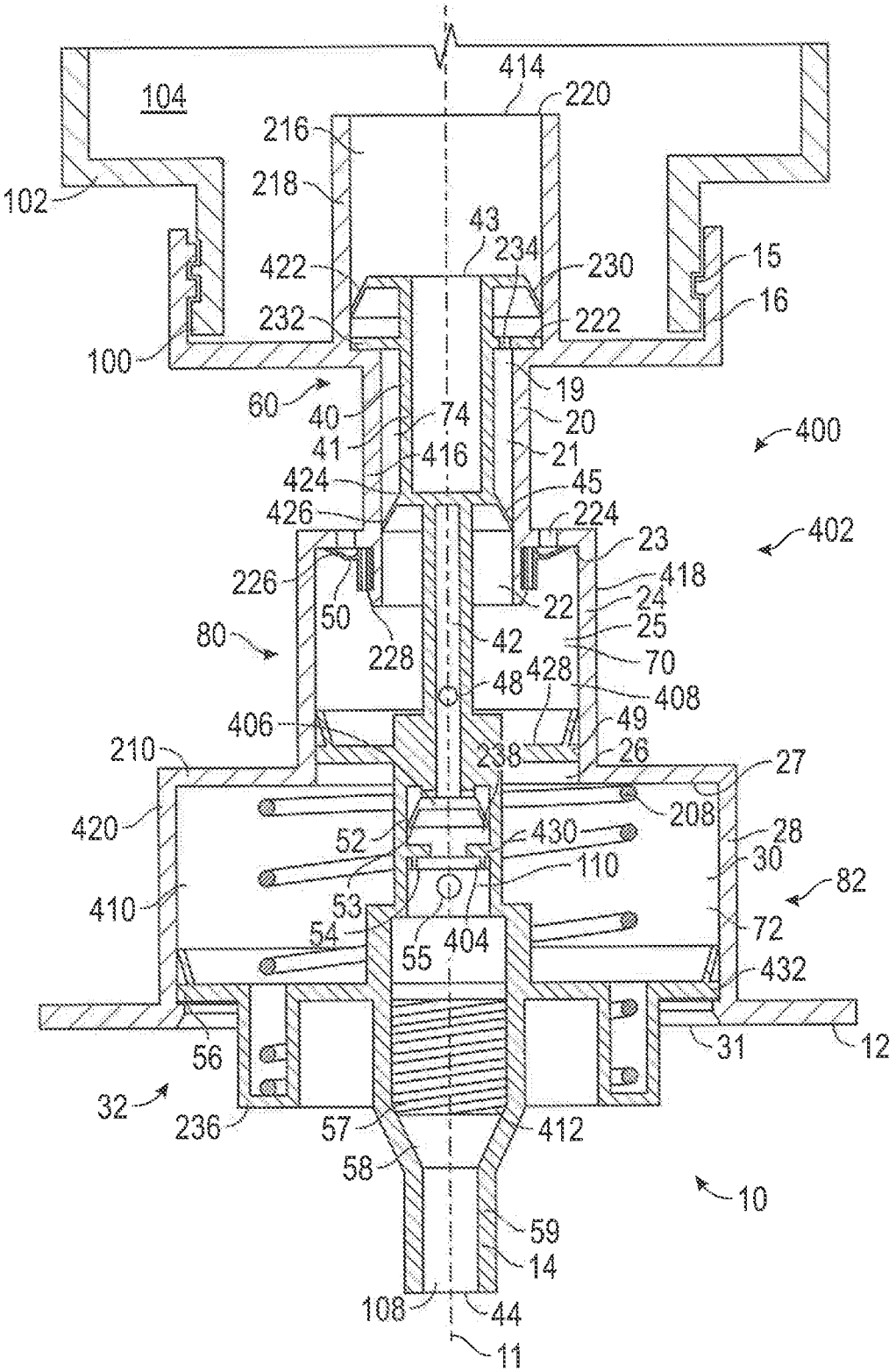
FIG. 5 is a front cross-sectional view of a pump in accordance with a third embodiment of the invention, with a piston-forming element in an extended position.
Figure 6:
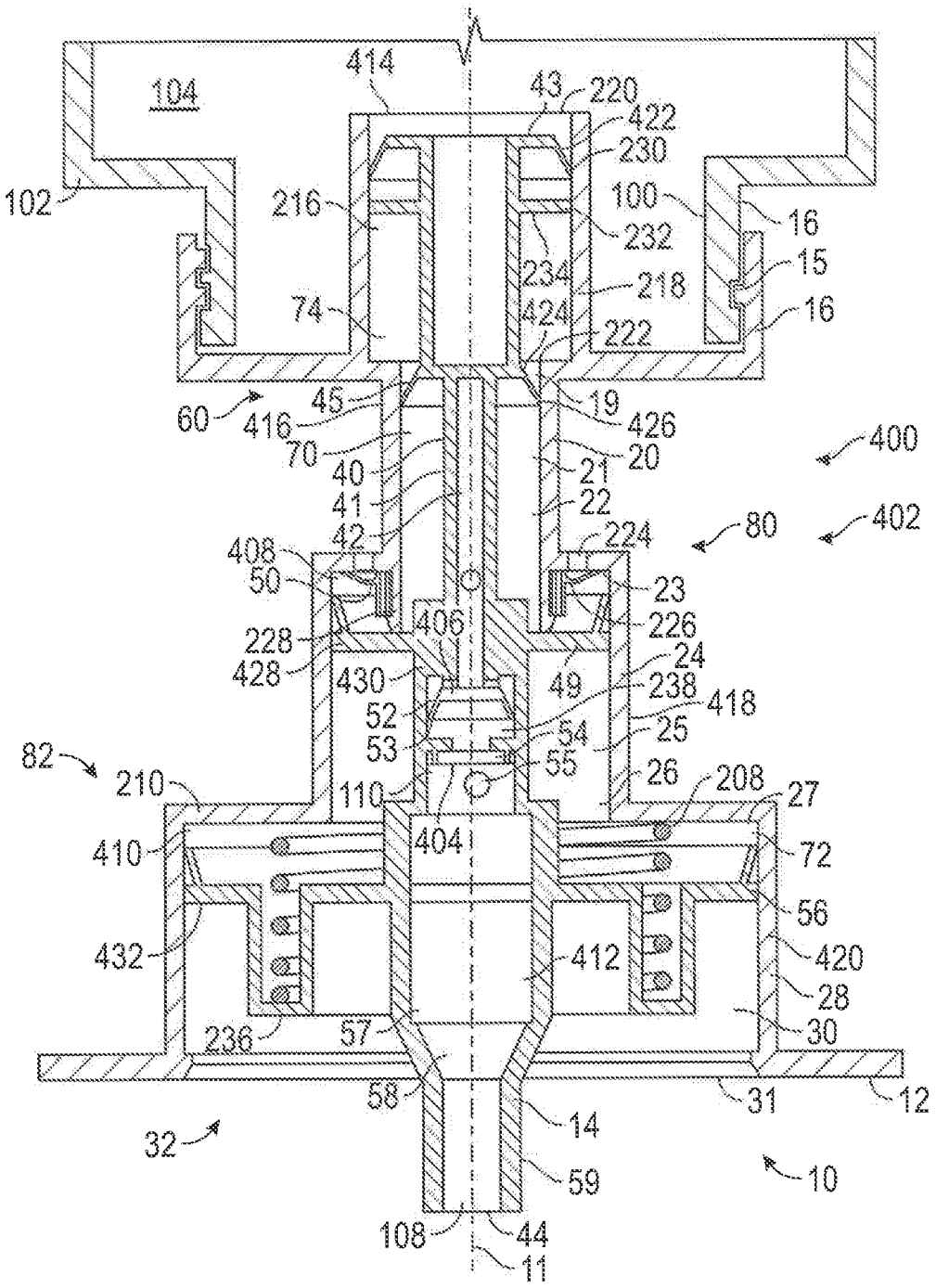
FIG. 6 is a front cross-sectional view of the pump of FIG. 5, with the piston-forming element in a retracted position.

Reference is now made to FIGS. 5 and 6, which show a pump 10 in accordance with a third embodiment of the invention. The pump 10 is generally identical to that shown in FIGS. 1 to 3, with a few notable exceptions as described below. Like numerals are used to represent like components.

In the embodiment shown in FIGS. 5 and 6, the piston-chamber forming body 12 includes an additional innermost chamber 216 that is positioned axially inwardly from the inner chamber 21, and that has a larger diameter than the inner chamber 21 for providing an out of phase operation of the liquid pump 60 and the first stage air pump 80. The innermost chamber 216 is defined within a cylindrical wall 218 coaxial about the axis 11 between an open inner end 220 of the innermost chamber 216 and an open outer end 222 of the innermost chamber 216. The innermost chamber 216 opens axially outwardly at its open outer end 22 into the axially inner end 19 of the inner chamber 21. In this embodiment of the invention, the inner end 19 of the inner chamber 21 is open.

The intermediate chamber 25 and the outer chamber 30 are generally identical to those shown in FIGS. 1 to 3, with the exception that an inner cylindrical wall 228 that is narrower in diameter than the outer cylindrical wall 24 extends axially outwardly from the inner end 23 of the intermediate chamber 25. The inner end 23 of the intermediate chamber 25 also has a number of air passages 224 open to the atmosphere. A one-way air intake valve 226 is secured annularly about the inner cylindrical wall 228 and closes the air passages 224 to fluid flow axially inwardly therethrough, but is deflectable to permit atmospheric air to flow axially outwardly therethrough and into the intermediate chamber 25.

The piston-forming element 14 includes a central stem 40 that is coaxially slidably received within the chamber cavity 32 of the piston chamber-forming body 12. Near the inner end 43 of the stem 40, a valve disc 230 extends radially outwardly from the stem 40 into engagement with the cylindrical wall 218 of the innermost chamber 216. The valve disc 230 engages the cylindrical wall 218 to prevent fluid flow axially inwardly therepast, and is resiliently deflectable radially inwardly to permit fluid flow axially outwardly therepast. The valve disc 230 thus serves as a one-way liquid inlet valve 422 for receiving liquid 104 from the reservoir 102. An alignment disc 232 is provided on the stem 40 axially outwardly from the valve disc 230. The alignment disc 232 extends radially outwardly from the stem 40 towards the cylindrical wall 218 of the innermost chamber 216, to help maintain the axial alignment of the stem 40 within the chamber cavity 32. A fluid channel 234 extends through the alignment disc 232 to allow for fluid flow axially therethrough.

As in the embodiment shown in FIGS. 1 to 3, in the embodiment of FIGS. 5 and 6, a valve disc 45 extends radially outwardly from the stem 40 into engagement with the cylindrical wall 20 of the inner chamber 21. In the embodiment of FIGS. 5 and 6, the valve disc 45 is spaced axially outwardly from the inner end 43 of the stem 40 and from the valve disc 230 and the alignment disc 232. The valve disc 45 engages the cylindrical wall 20 to prevent fluid flow axially inwardly therepast, and is resiliently deflectable radially inwardly to permit fluid flow axially outwardly therepast. The inner seal disc 47 and the inner ports 46 are not present in this embodiment.

Axially outwardly from the valve disc 45, an intermediate seal disc 49 extends radially outwardly from the stem 40 into engagement with the cylindrical wall 24 of the intermediate chamber 25. Unlike the embodiment shown in FIGS. 1 to 3, in the embodiment of FIGS. 5 and 6, the intermediate seal disc 49 does not have passage openings 51 and does not carry a one-way inlet valve 50. Intermediate ports 48 are provided through the cylindrical wall 41 of the stem 40, between the valve disc 45 and the intermediate seal disc 49, providing fluid communication into the central passageway 42.

As in the embodiment shown in FIGS. 1 to 3, in the embodiment of FIGS. 5 and 6, a one-way exit valve 52 and a screen 54 are provided within the central passageway 42 axially outwardly of the intermediate ports 48. Outer ports 55 and an outer seal disc 56 are also provided axially outwardly of the screen 54. In the embodiment of FIGS. 5 and 6, the outer seal disc 56 has an annular seat 236 that carries a coil spring 208. The spring 208 extends between the outer seal disc 56 and the inner end 27 of the outer chamber 30, biasing the piston-forming element 14 axially outwards relative to the piston chamber-forming body 12 towards the extended position shown in FIG. 5. A foaming plug 57 is also provided within the central passageway 42 axially outwardly of the outer ports 55, and axially inwardly of the discharge opening 108.

In the embodiment of FIGS. 5 and 6, the liquid pump 60 and the variable volume liquid compartment 74 are defined between the innermost valve disc 230 and the inner valve disc 45 within the innermost chamber 216 and the inner chamber 21; the first stage air pump 80 and the variable volume first air compartment 70 are defined between the inner valve disc 45 and the intermediate seal disc 49 within the inner chamber 21 and the intermediate chamber 25; and the second stage air pump 82 and the variable volume second air compartment 72 are defined between the intermediate seal disc 49 and the outer seal disc 56 within the intermediate chamber 25 and the outer chamber 30.

The liquid pump 60 of FIGS. 5 and 6 is formed as a stepped cylinder displacement pump, which incorporates both the inner chamber 21 and the larger diameter innermost chamber 216, with the movable valve disc 230 of the piston-forming element 14 serving as the one-way liquid inlet valve 422 for receiving liquid 104 from the reservoir 102. In contrast, in the embodiment shown in FIGS. 1 to 3, the liquid pump 60 is formed as a single diameter pump with the stationary one-way valve 13 serving as the one-way liquid inlet valve 422 for receiving liquid 104 from the reservoir 102.

The pump 10 of FIGS. 5 and 6 operates in much the same manner as that shown in FIGS. 1 to 3, with the notable exception that the liquid pump 60 and the first stage air pump 80 are out of phase. When activated, the piston-forming element 14 slides axially inwardly relative to the piston chamber-forming body 12 from the extended position shown in FIG. 5 towards the retracted position shown in FIG. 6 in a retraction stroke, and then slides axially outwardly relative to the piston chamber-forming body 12 from the retracted position to the extended position under the biasing force of the spring 208 in a withdrawal stroke.

During the retraction stroke, the innermost valve disc 230 slides axially inwardly towards the inner end 220 of the innermost chamber 216, and the inner valve disc 45 slides axially inwardly towards the inner end 19 of the inner chamber 21, thus displacing the liquid compartment 74 axially inwardly. As the diameter of the innermost chamber 216 is greater than the diameter of the inner chamber 21, this increases the volume of the liquid compartment 74, creating a vacuum. The vacuum draws liquid 104 from the reservoir 102 axially outwardly past the innermost valve disc 230 and into the liquid compartment 74.

During the withdrawal stroke, the innermost valve disc 230 slides axially outwardly towards the outer end 222 of the innermost chamber 216, and the inner valve disc 45 slides axially outwardly towards the outer end 22 of the inner chamber 21, thus displacing the liquid compartment 74 axially outwardly. This decreases the volume of the liquid compartment 74, forcing an allotment of the liquid 104 from the liquid compartment 74 axially outwardly past the inner valve disc 45 and into the variable volume first air compartment 70. The liquid pump 60 thus draws liquid 104 from the reservoir 102 during the retraction stroke and discharges liquid 104 into the variable volume first air compartment 70 during the withdrawal stroke.

The first stage air pump 80 of FIGS. 5 and 6 operates in much the same manner as in the embodiment shown in FIGS. 1 to 3. During the retraction stroke, the inner valve disc 45 slides axially inwardly towards the inner end 19 of the inner chamber 21, and the intermediate seal disc 49 slides axially inwardly towards the inner end 23 of the intermediate chamber 25, thus displacing the first air compartment 70 axially inwardly. As the diameter of the inner chamber 21 is smaller than the diameter of the intermediate chamber 25, this decreases the volume of the first air compartment 70, increasing the pressure within the first air compartment 74.

The one-way exit valve 52 is configured to prevent fluid flow from the first air compartment 70 axially outwardly therepast until a preselected threshold pressure is reached. Once the threshold pressure is reached, the valve disc 53 of the exit valve 52 deflects radially inwardly, allowing the pressurized air and liquid 104 from the first air compartment 70 to flow axially outwardly therepast. A short high pressure passageway 238 directs the pressurized air and liquid 104 from the exit valve 52 to the screen 54. The high pressure passageway 238 has a short axial length and a limited volume, which are selected so that the pressure within the passageway 238 rapidly elevates when the pressurized air and liquid 104 are received from the first air compartment 70. The high pressure passageway 238 is configured to deliver the air and the liquid 104 through the screen 54 at an elevated pressure that is preferably at least 0.5 bar above atmospheric pressure. The air and the liquid 104 turbulently mix as they pass through the screen 54 at the elevated pressure, generating a first foam that is discharged into the central passageway 42 axially outwardly from the screen 54.

During the withdrawal stoke, the inner valve disc 45 slides axially outwardly towards the outer end 22 of the inner chamber 21, and the intermediate seal disc 49 slides axially outwardly towards the outer end 26 of the intermediate chamber 25, thus displacing the first air compartment 70 axially outwardly. This increases the volume of the first air compartment 70, creating a vacuum that draws atmospheric air into the first air compartment 70 through the air passages 224. Unlike in the embodiments shown in FIGS. 1 to 4, in the embodiment shown in FIGS. 5 and 6, the air is drawn into the first air compartment 70 directly from the atmosphere through the air passages 224, rather than indirectly through the second air compartment 72 from the discharge opening 108. The first air compartment 70 also receives the allotment of liquid 104 that is discharged from the liquid pump 60 during the withdrawal stroke. The relative diameters of the innermost chamber 216, the inner chamber 21, and the intermediate chamber 25 are selected so that the increase in volume of the first air compartment 70 during the withdrawal stroke is not completely offset by the inflow of liquid 104 from the liquid pump 60. This ensures that a vacuum is created despite the inflow of liquid 104, which causes the first air compartment 70 to draw in atmospheric air.

The first stage air pump 80 thus draws air and liquid 104 during the withdrawal stroke and discharges the air and liquid 104 during the retraction stroke. The first stage air pump 80 is thus out of phase with the liquid pump 60, in that it discharges fluid while the liquid pump 60 is drawing fluid, and it draws fluid while the liquid pump 60 is discharging fluid. This configuration helps to avoid the production of countervailing forces between the liquid pump 60 and the first stage air pump 80, since the liquid pump 60 discharges into the first air compartment 70 while it is under vacuum rather than when it is pressurized.

The second stage air pump 82 operates in an identical manner to that shown in FIGS. 1 to 3, and operates in phase with the first stage air pump 80. During the retraction stroke, the second air compartment 72 is compressed, forcing air from the second air compartment 72 through the outer ports 55 and into the central passageway 42. The air from the second air compartment 72 is then passed through the foaming plug 57, together with the first foam received from the screen 54, which turbulently mixes the fluids to generate a second foam that is discharged from the discharge opening 108. As there is no pressurizing valve positioned between the second air compartment 72 and the foaming plug 57, the pressure within the second air compartment 72 does not rise significantly above atmospheric pressure during the retraction stroke, and preferably rises only about 100 mBar or less above atmospheric pressure. The first foam and the air from the second air compartment 72 are thus delivered through the second foam generator 412 at a reduced pressure that is lower than the elevated pressure at which the liquid 104 and the air from the first air compartment 70 are delivered through the first foam generator 404.

During the withdrawal stroke, the volume of the second air compartment 72 increases, creating a vacuum which draws atmospheric air into the second air compartment 72 via the discharge opening 108, the central passageway 42, the foaming plug 57, and the outer ports 55.

Figure 7:
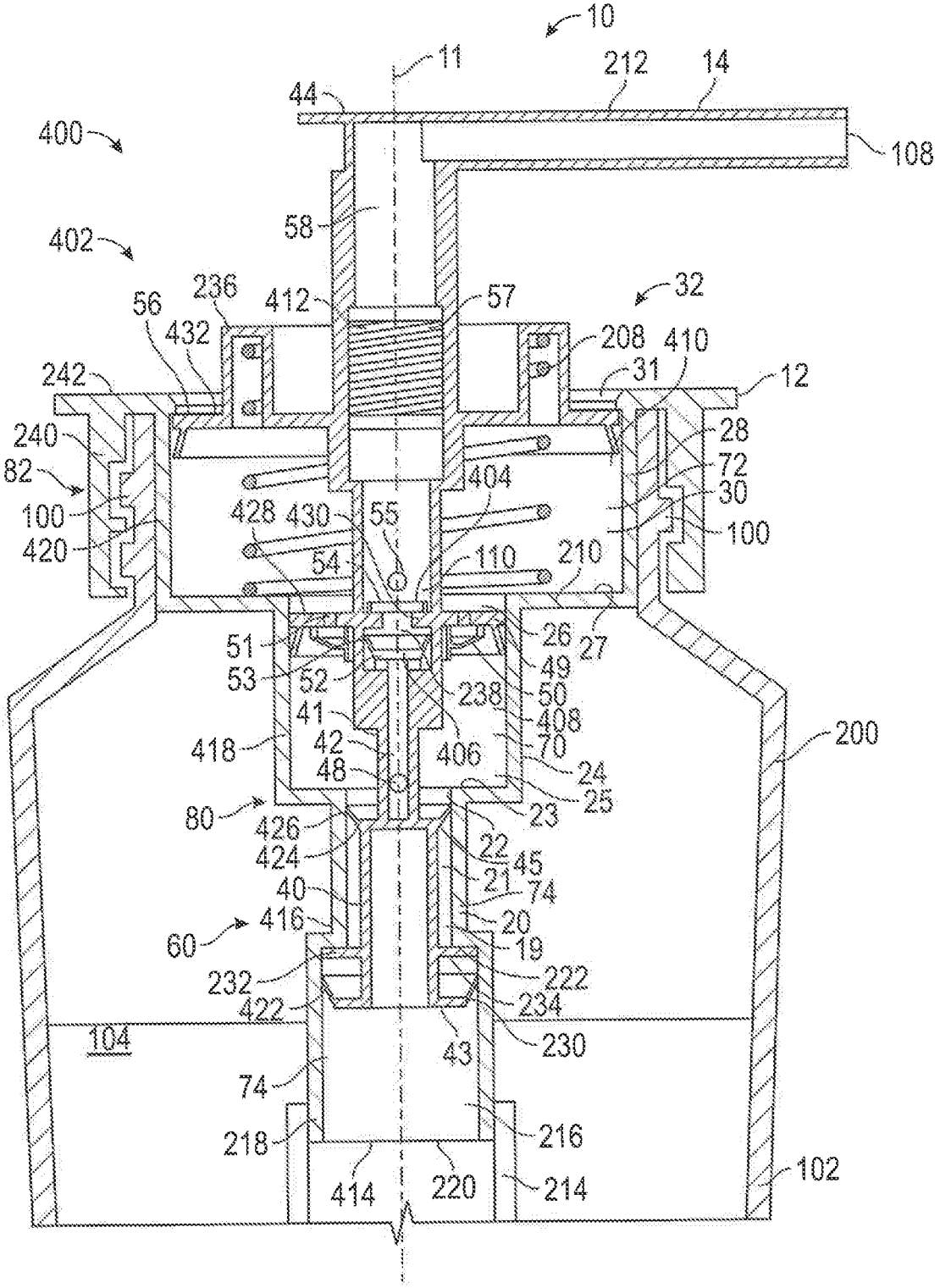
FIG. 7 is a cross-sectional side view of a pump in accordance with a fourth embodiment of the invention, with a piston-forming element in an extended position.
Figure 8:
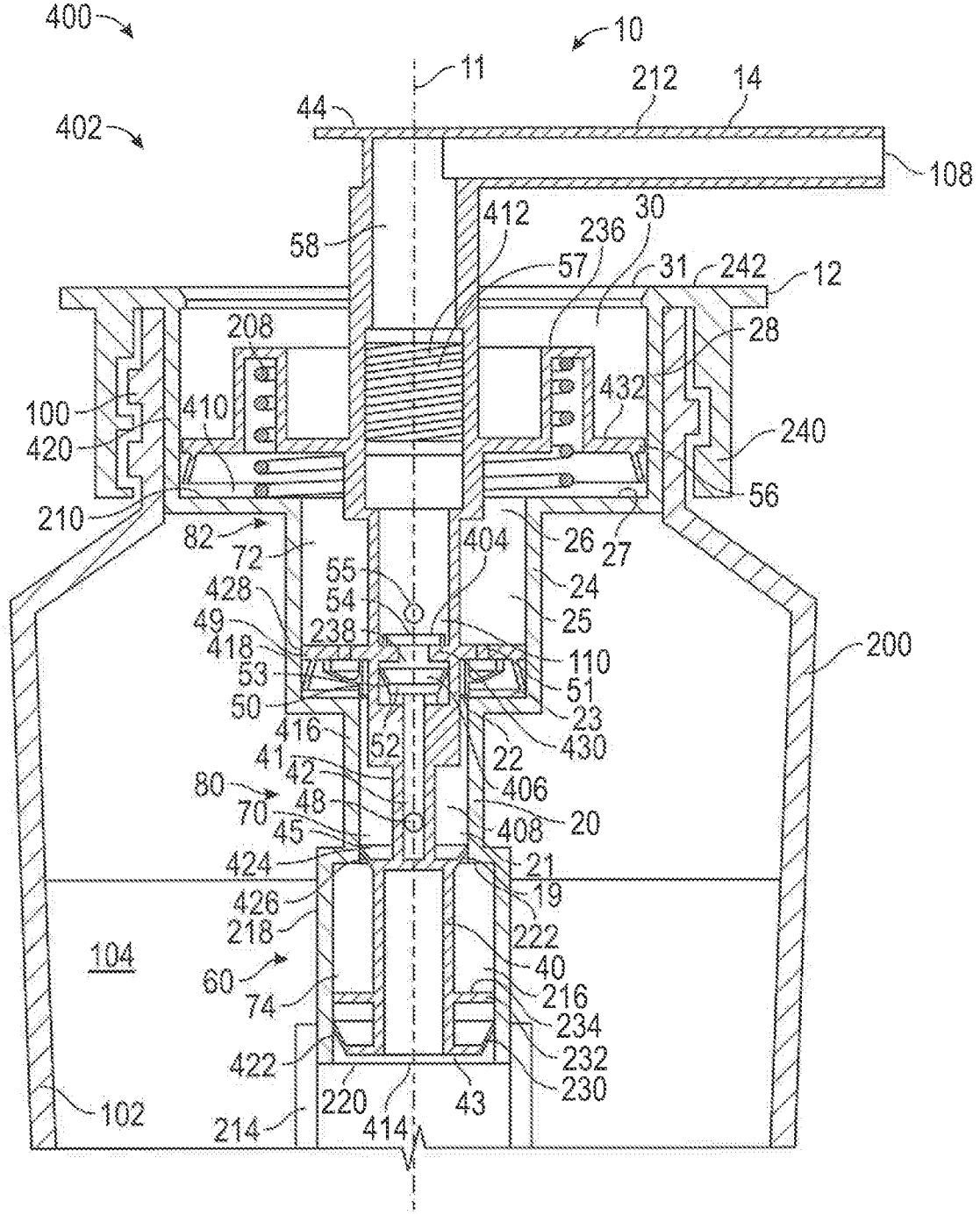
FIG. 8 is a cross-sectional side view of the pump of FIG. 7, with the piston-forming element in a retracted position.
Figure 9:
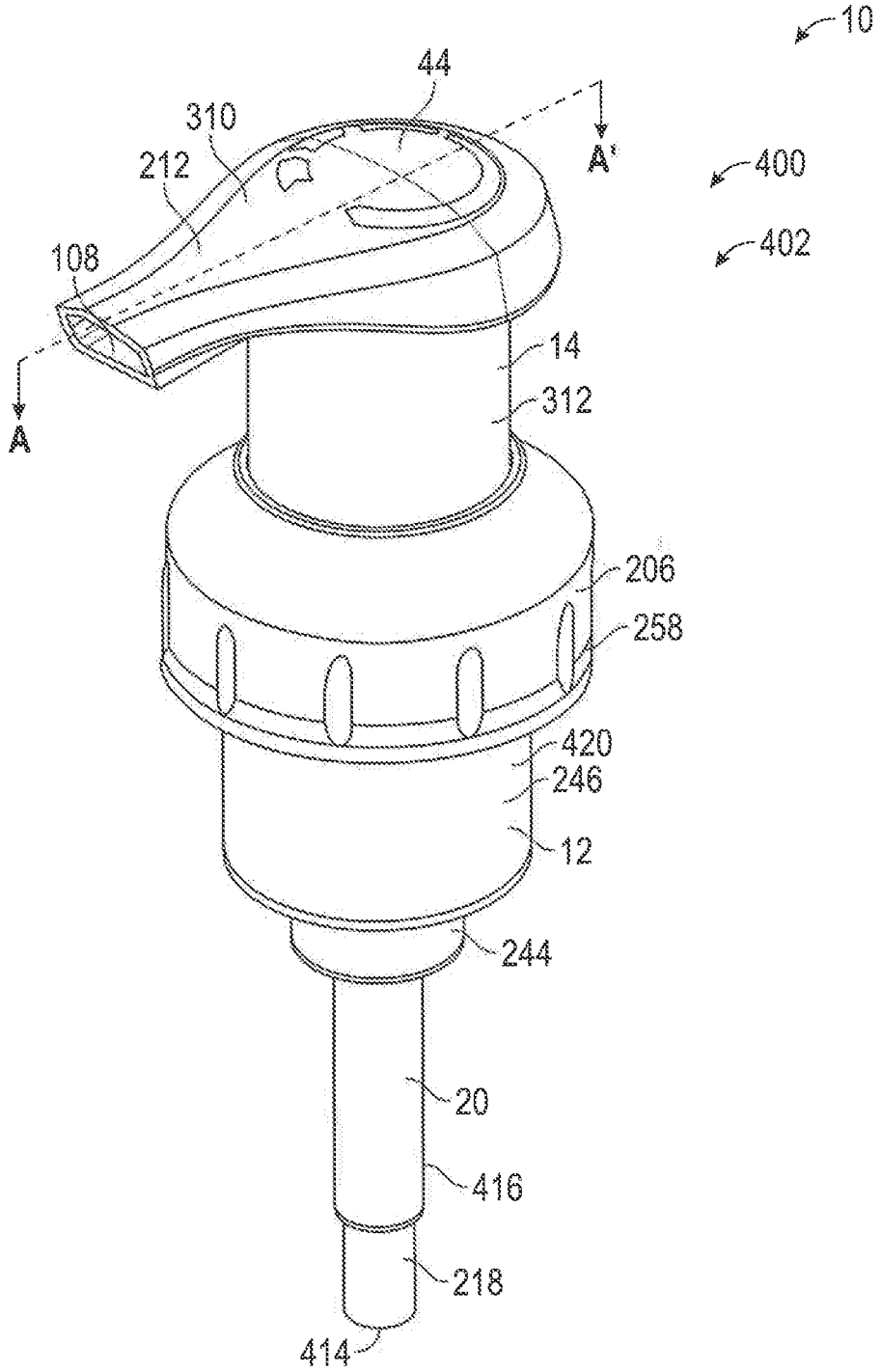
FIG. 9 is a perspective view of a pump in accordance with a fifth embodiment of the invention.

Reference is now made to FIGS. 7 and 8, which show a pump 10 in accordance with a fourth embodiment of the invention. The pump 10 is similar to that shown in FIGS. 5 and 6, with the exception that it has been adapted for drawing liquid 104 from an upwardly open bottle 200, similarly to the embodiment shown in FIG. 4. Like numerals are used to denote like components.

In the embodiment of FIGS. 7 and 8, the piston chamber-forming body 12 has an annular flange 242 that extends radially outwardly from the outer end 31 of the outer chamber 30, and a threaded cylindrical wall 240 that extends axially inwardly from the annular flange 242. The threaded wall 240 is spaced radially outwardly from the cylindrical wall 28 of the outer chamber 30, and is configured to threadedly engage with the threaded neck 100 of the bottle 200. The annular flange 242 engages with the top of the threaded neck 100, preventing the piston-chamber forming body 12 from moving axially inwardly relative to the bottle 200. The threaded engagement of the threaded wall 240 and the threaded neck 100 further prevents the piston-chamber forming body 12 from moving axially inwardly or axially outwardly relative to the bottle 200 when engaged.

As in the embodiment shown in FIG. 4, in FIGS. 7 and 8 a discharge tube 212 extends radially outwardly from the outer end 44 of the stem 40, and a dip tube 214 extends axially inwardly from the inner end 43 of the stem 40. The intermediate seal disc 49 also has passage openings 51 and a one-way inlet valve 50. The first air compartment 70 draws atmospheric air from the discharge opening 108, through the passage openings 51 and the one-way inlet valve 50, as in the embodiments shown in FIGS. 1 to 4, rather than through air passages 224 in the intermediate chamber 25, as in the embodiment shown in FIGS. 5 and 6. Otherwise, the pump 10 of FIGS. 7 and 8 is essentially identical to that shown in FIGS. 5 and 6, and operates in the same manner, with the liquid pump 60 and the first stage air pump 80 operating out of phase, and the first stage air pump 80 and the second stage air pump 82 operating in phase.

Reference is now made to FIGS. 9 to 13, which show a pump 10 in accordance with a fifth embodiment of the invention. The pump 10 of FIGS. 9 to 13 is functionally similar to those shown in FIGS. 1 to 8, but has a number of structural differences as described below. Like numerals are used to denote like components.

As in the previous embodiments, in FIGS. 9 to 13 the pump 10 comprises a piston chamber-forming body 12 and a piston-forming element 14 that is coaxially received within a chamber cavity 32 of the piston-chamber forming body 12 for reciprocal axial movement relative thereto.

The piston chamber-forming body 12 provides an innermost chamber 216, an inner chamber 21, an intermediate chamber 25, and an outer chamber 30. The innermost chamber 216 is defined within a cylindrical wall 218 coaxial about the axis 11 between an open inner end 220 of the innermost chamber 216 and an outer end 222 of the innermost chamber 216. The outer end 222 of the innermost chamber 216 is closed but for a central opening 17, which opens axially outwardly to an inner end 19 of the inner chamber 21.

The inner chamber 21 is defined within a cylindrical wall 20 coaxial about the axis 11 between the inner end 19 of the inner chamber 21 and an open outer end 22 of the inner chamber 21. The inner chamber 21 opens axially outwardly at its open outer end 22 into an inner end 23 of the intermediate chamber 25.

The intermediate chamber 25 is defined within a cylindrical wall 24 coaxial about the axis 11 extending from the inner end 23 of the intermediate chamber 25 and open axially at an outer end 26 of the intermediate chamber 25. The cylindrical wall 24 of the intermediate chamber 25 extends coaxially into the outer chamber 30, and the open outer end 26 of the intermediate chamber 25 opens into the middle of the outer chamber 30.

The outer chamber 30 extends from an inner end 27 to an open outer end 31, and is defined within a first outer cylindrical wall 244 and a second outer cylindrical wall 246, both of which are coaxial about the axis 11. The first outer cylindrical wall 244 extends radially outwardly from the inner end 23 of the intermediate chamber 25 to form an annular spring seat 248 at the inner end 27 of the outer chamber 30, and then extends axially outwardly to an outer edge 250. The outer edge 250 of the first outer cylindrical wall 244 is positioned axially inwardly from the outer end 26 of the intermediate chamber 25. The second outer cylindrical wall 246 extends radially outwardly from the first outer cylindrical wall 244, and then extends axially outwardly to the open outer end 31 of the outer chamber 30. The outer end 31 of the outer chamber 30 is positioned axially outwardly from the outer end 26 of the intermediate chamber 25. The second outer cylindrical wall 246 has a radially outwardly facing cap engaging groove 252 near the outer end 31, and an air intake opening 254 positioned axially inwardly from the cap engaging groove 252.

A cap 206 surrounds the outer end 31 of the outer chamber 30, and engages with the cap engaging groove 252 in a friction-fit. The cap 206 has a threaded wall 258 that is spaced radially outwardly from the second outer cylindrical wall 246. Although not shown, the threaded wall 258 is configured to threadedly engage with the threaded neck 100 of an upwardly open bottle 200, similar to the embodiments shown in FIGS. 4, 7, and 8.

A one-way valve 13 is received in a friction-fit within the central opening 17 in the outer end 222 of the innermost chamber 216. The one-way valve 13 carries a valve disc 106 at one end of a tubular stem 107. The stem 107 extends through the central opening 17 to locate the valve disc 106 coaxially within the inner end 19 of the inner chamber 21. One or more valve channels 256 extend through the stem 107 to communicate fluid from the innermost chamber 216 to the inner end 19 of the inner chamber 21, axially inwardly from the valve disc 106. The valve disc 106 extends radially outwardly to a distal end in sealing engagement with the cylindrical wall 20 of the inner chamber 21. The valve disc 106 engages the cylindrical wall 20 of the inner chamber 21 to prevent fluid flow axially inwardly therepast, and deflects radially inwardly to permit fluid flow axially outwardly therepast.

The piston-forming element 14 includes a central stem 40 that is coaxial about the axis 11 and extends from an axial inner end 43 to an axial outer end 44. The stem 40 has a first stem portion 260 that extends axially outwardly from the inner end 43 to a first connecting end 264, and a second stem portion 262 that extends axially inwardly from the outer end 44 to a second connecting end 266 that engages with the first connecting end 264. A central passageway 42 is provided within the stem 40. The central passageway 42 connects to a discharge tube 212 that extends radially outwardly from the outer end 44 of the stem 40 to a discharge opening 108.

Near the inner end 43 of the stem 40, a valve disc 45 extends radially outwardly from the first stem portion 260 into engagement with the cylindrical wall 20 of the inner chamber 21. The valve disc 45 engages the cylindrical wall 20 to prevent fluid flow axially inwardly therepast. The valve disc 45 is resiliently deflectable and deflects radially inwardly from the cylindrical wall 20 to permit fluid flow axially outwardly therepast. Inner ports 46 are provided through the cylindrical wall 41 of the stem 40 axially outwardly from the valve disc 45.

The diameter of the cylindrical wall 41 increases axially outwardly from the inner ports 46 to provide a ball seat 268, and a one-way ball valve 270 is provided within the central passageway 42 between the ball seat 268 and the second connecting end 266 of the second stem portion 262. The ball valve 270 comprises a ball 272 and a valve spring 274 that extends between the second connecting end 266 and the ball 272. The valve spring 274 biases the ball 272 into sealing engagement with the ball seat 268, and prevents fluid from flowing axially outwards past the ball 272 unless a sufficient axially outwards force is applied to the ball 272 to compress the spring 274 and move the ball 272 out of engagement with the ball seat 268. The spring 274 is configured to compress, thereby opening the valve 270, when a preselected threshold pressure is applied to the axial inner side of the ball 272.

Figure 12:
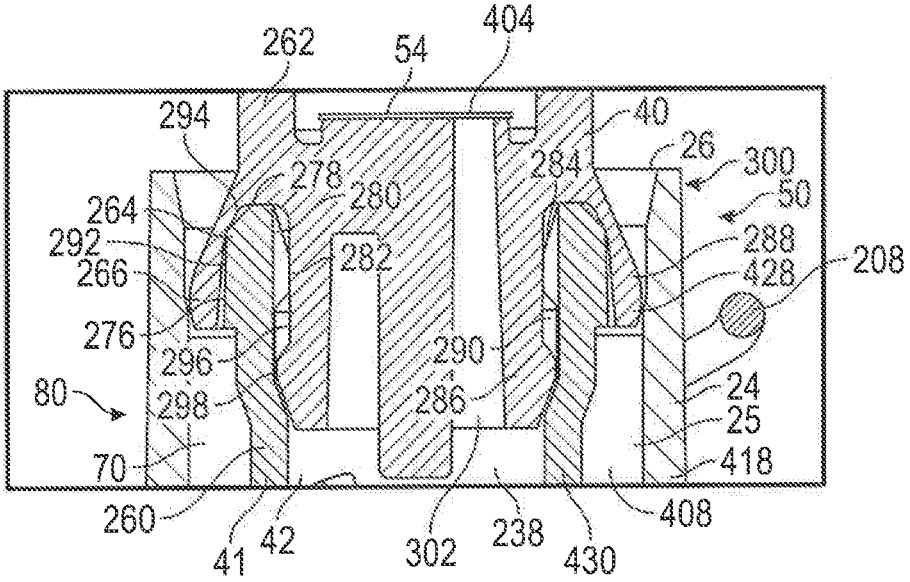
FIG. 12 is an enlarged view of area B of the cross-sectional view shown in FIG. 11, showing a lost link air valve in a closed position.
Figure 13:
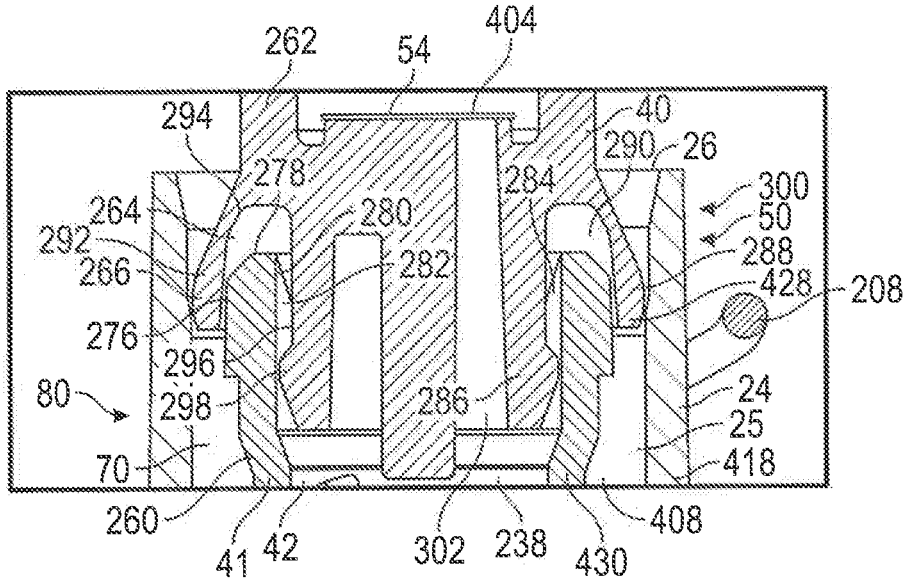
FIG. 13 is an enlarged view of area B as shown in FIG. 12, showing the lost link air valve in an open position.

The connection between the first connecting end 264 of the first stem portion 260 and the second connecting end 266 of the second stem portion 262 is best shown in FIGS. 12 and 13. The first connecting end 264 has an outer surface 276, an upper surface 278, and an inner surface 280. A first linking ridge 282 extends radially inwardly from the inner surface 280. The first linking ridge 282 has a number of fluid paths 284 cut therethrough that allow fluid to flow axially past the first linking ridge 282.

The second connecting end 266 has an inner linking member 286 and an outer linking member 288. The outer linking member 288 is spaced radially outwards from the inner linking member 288 to provide a link cavity 290 therebetween. The link cavity 288 receives the first connecting end 264 of the first stem portion 260, and has an outer cavity surface 292, an upper cavity surface 294, and an inner cavity surface 296. A second linking ridge 298 extends radially outwards from the inner cavity surface 296.

The first connecting end 264 and the second connecting end 266 form a lost link air valve 300 that is similar to those described in U.S. Pat. No. 7,337,930 to Ophardt et al., issued Mar. 4, 2008, which is incorporated herein by reference. The first connecting end 264 is axially movable relative to the second connecting end 266 between a closed position, shown in FIG. 12, and an open position, shown in FIG. 13. When in the closed position, the upper surface 278 of the first connecting end 264 engages with the upper cavity surface 294 of the link cavity 290, which prevents fluid from flowing radially past the first connecting end 264 between the central passageway 42 and the intermediate chamber 25. When in the open position, the first connecting end 264 is displaced axially inwardly relative to the second connecting end 266, and the upper surface 278 of the first connecting end 264 disengages from the upper cavity surface 294 of the link cavity 290. This allows fluid to flow from the central passageway 42 into the intermediate chamber 25 by flowing through the fluid paths 284, between the upper surface 278 and the upper cavity surface 294, and between the outer surface 276 and the outer cavity surface 292. The axial movement of the first connecting end 264 relative to the second connecting end 266 is limited by engagement of the first linking ridge 282 with the second linking ridge 298 when in the open position.

The outer linking member 288 of the second connecting end 266 is configured to sealingly engage with the cylindrical wall 24 of the intermediate chamber 25, preventing fluid flow axially therepast. The inner linking member 286 defines a fluid passageway 302 that serves to extend the central passageway 42 from the first stem portion 260 into the second stem portion 262. The fluid passageway 302 is narrower than the central passageway 42 axially inwardly and axially outwardly therefrom. The narrowing of the fluid passageway 302 increases the mixing and velocity of fluid flowing axially therethrough. A foaming screen 54 is positioned at the axial outer end of the fluid passageway 302.

Outer ports 55 are provided through the cylindrical wall 41 of the stem 40 axially outwardly from the screen 54, and a channel narrowing body 304 is positioned within the central passageway 42 axially outwardly from the outer ports 55. The channel narrowing body 304 narrows the path for fluid to flow axially therepast, which increases the velocity and mixing of the fluid. Two foaming plugs 57 are positioned within the central passageway 42 axially outwardly from the channel narrowing body 304. The central passageway 42 continues axially outwardly from the foaming plugs 57, and connects with the discharge tube 212 that extends radially outwardly to the discharge opening 108.

An outer seal disc 56 extends radially outwardly from the cylindrical wall 41 of the stem 40 axially outwardly from the outer ports 55 and axially inwardly from the foaming plugs 57. The outer seal disc 56 has an annular seat 236, similar to the embodiment shown in FIGS. 7 and 8. A coil spring 208 extends between the annular seat 236 of the outer seal disc 56 and the annular spring seat 248 of the first outer cylindrical wall 244. The outer seal disc 56 engages the second cylindrical wall 246 of the outer chamber 30, and has a number of air receiving channels 306 that extend therethrough. A one-way annular air valve 308 is secured to the outer seal disc 56 and closes the air receiving channels 306 to fluid flow axially outwardly therethrough but is deflectable to permit fluid flow axially inwardly therepast. The one-way annular air valve 308 thus functions as a second one-way air receiving valve 434.

The piston-forming element 14 has an outlet body 310 at the axial outer end 44 of the stem 40. The outlet body 310 is closed at the axial outer end 44, and is open laterally at the discharge opening 108. A cylindrical outlet wall 312 extends axially inwardly from the outlet body 310, and is spaced radially outwardly from the cylindrical wall 41 of the stem 40 and radially inwardly from the cap 206. An internal air reservoir 316 is provided between the cylindrical outlet wall 312 and the cylindrical wall 41 of the stem 40, and an air passageway 314 between the cylindrical outlet wall 312 and the cap 206 allows the internal air reservoir 316 to receive atmospheric air from outside of the pump 10.

In the embodiment of FIGS. 9 to 13, the liquid pump 60 and the variable volume liquid compartment 74 are defined between the one-way valve 13 and the inner seal disc 47 within the inner chamber 21; the first stage air pump 80 and the variable volume first air compartment 70 are defined between the inner seal disc 47 and the outer linking member 288 within the inner chamber 21 and the intermediate chamber 25; and the second stage air pump 82 and the variable volume second air compartment 72 are defined between the outer linking member 288 and the outer seal disc 56 within the intermediate chamber 25 and the outer chamber 30.

Figure 10:
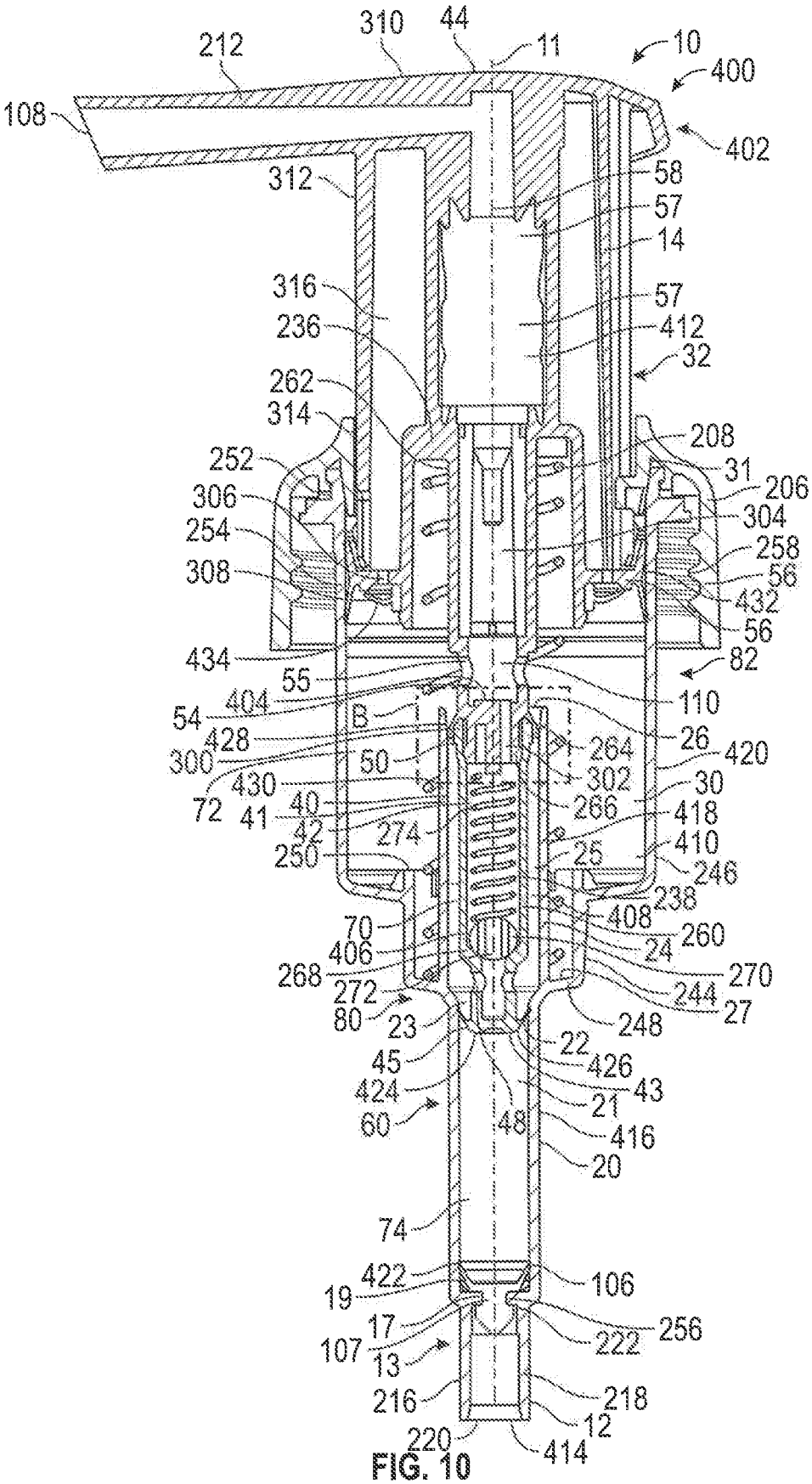
FIG. 10 is a cross-sectional view of the pump shown in FIG. 9, taken along line A-A', and showing a piston-forming element in an extended position.
Figure 11:
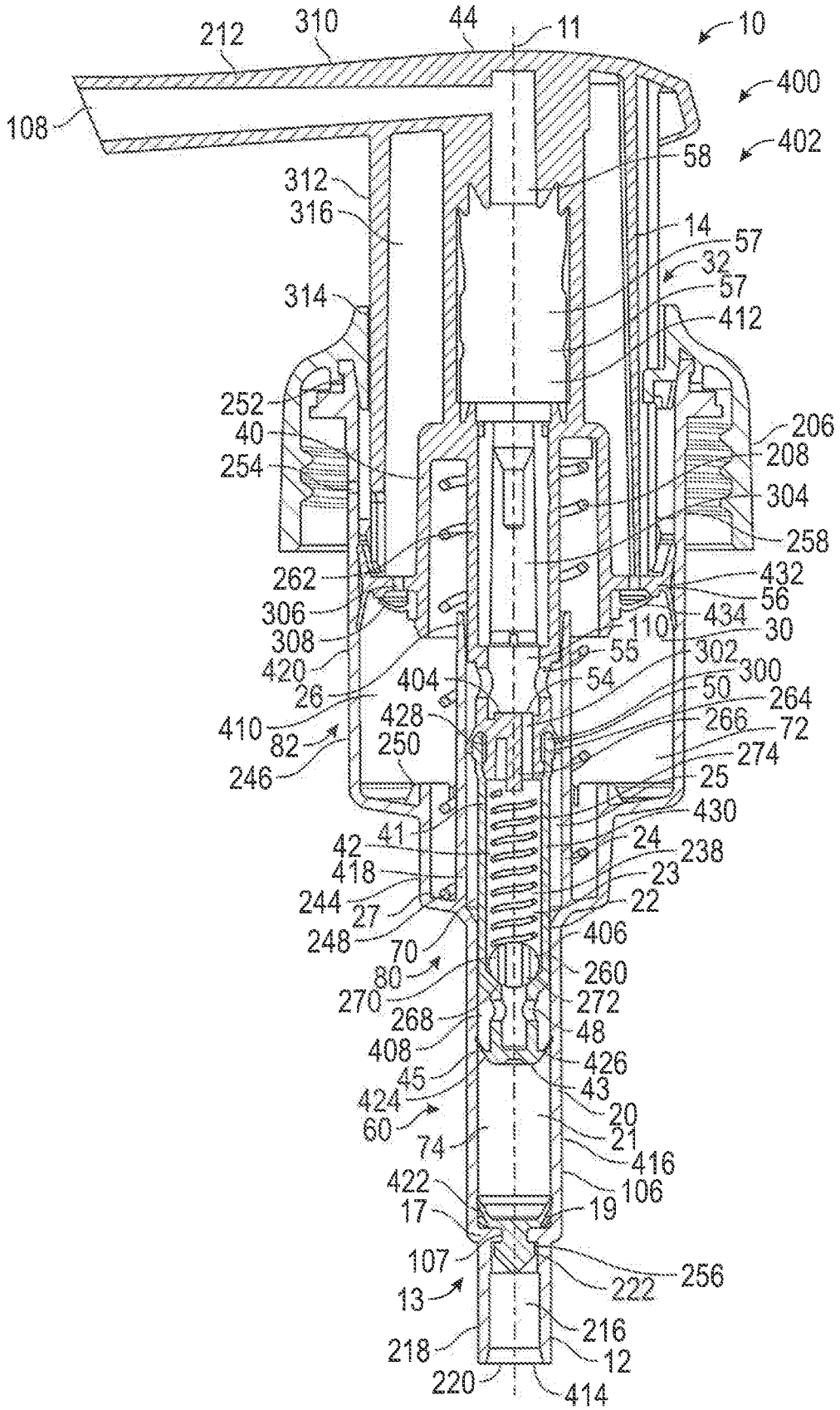
FIG. 11 is a cross-sectional view of the pump shown in FIG. 10, with the piston-forming element in a retracted position.

When activated, the piston-forming element 14 slides axially inwardly relative to the piston chamber-forming body 12 from the extended position shown in FIG. 10 towards the retracted position shown in FIG. 11 in a retraction stroke or instroke, and then slides axially outwardly relative to the piston chamber-forming body 12 from the retracted position to the extended position under the biasing force of the spring 208 in a withdrawal stroke or outstroke in a cycle of operation. The pump 10 may be activated, for example, by manually depressing the outlet body 310 with a user's hand.

During the retraction stroke, the inner seal disc 47 slides axially inwardly towards the inner end 19 of the inner chamber 21. This decreases the volume of the liquid compartment 74, forcing liquid 104 contained within the liquid compartment 74 to flow axially outwardly past the inner seal disc 47 and into the first air compartment 70. The outer linking member 288 simultaneously slides axially inwardly towards the inner end 23 of the intermediate chamber 25. This decreases the volume of the first air compartment 70, causing the pressure within the first air compartment 70 to rise. Once the threshold pressure is reached, the valve spring 274 compresses and the ball 272 moves axially outwardly from the ball seat 268, allowing the pressurized air and liquid to flow axially outwardly therepast. The pressurized air and liquid are then directed axially outwardly through the screen 54 at an elevated pressure that is preferably at least 0.5 bar above atmospheric pressure. The air and the liquid 104 turbulently mix as they pass through the screen 54 at the elevated pressure, generating a first foam that is discharged into the central passageway 42 axially outwardly from the screen 54. The outer seal disc 56 simultaneously slides axially inwardly towards the inner end 27 of the outer chamber 30. This decreases the volume of the second air compartment 72, forcing air from the second air compartment 72 through the outer ports 55 and into the central passageway 42. The air from the second air compartment 72 is then passed through the foaming plugs 57, together with the first foam received from the screen 54, which turbulently mixes the fluids to generate a second foam that is discharged through the discharge tube 212 and out the discharge opening 108. As there is no pressurizing valve positioned between the second air compartment 72 and the foaming plugs 57, the pressure within the second air compartment 72 does not rise significantly above atmospheric pressure during the retraction stroke, and preferably rises only about 100 mBar or less above atmospheric pressure.

During the withdrawal stroke, the inner seal disc 47 slides axially outwardly towards the outer end 22 of the inner chamber 21. This increases the volume of the liquid compartment 74, creating a vacuum that draws liquid 104 past the one-way valve 13 from the bottle 200 into the liquid compartment 74. The outer linking member 288 simultaneously slides axially outwardly towards the outer end 26 of the intermediate chamber 25. This increases the volume of the first air compartment 70, creating a vacuum. The axial outwards movement of the outer linking member 288 also causes the upper surface 278 of the first connecting end 264 of the first stem portion 260 to disengage from the upper cavity surface 294 of the link cavity 290, thus opening the lost link air valve 300. With the lost link air valve 300 open, the vacuum within the first air compartment 70 draws air into the first air compartment 70 from the second air compartment 72 via the outer ports 55, the screen 54, the central passageway 42, and the lost link air valve 300. The outer seal disc 56 simultaneously slides axially outwardly towards the outer end 31 of the outer chamber 30. This increases the volume of the second air compartment 72, creating a vacuum that draws air from the internal air reservoir 316 via the air receiving channels 306 and the one-way annular air valve 308. Atmospheric air is also drawn into the second air compartment 72 through the discharge opening 108, the discharge tube 212, the central passageway 42, the foaming plugs 57, and the outer ports 55.

The axial inwards movement of the second stem portion 262 during the retraction stroke causes the upper cavity surface 294 of the link cavity 290 to sealingly engage with the upper surface 278 of the first connecting end 264 of the first stem portion 260, thus closing the lost link air valve 300. The lost link air valve 300 thus functions as a one-way air inlet valve 50 that allows fluid to enter the first air compartment 70 from the second air compartment 72 through the one-way air inlet valve 50 during the withdrawal stroke, but prevents fluid from entering the second air compartment 72 from the first air compartment 70 through the one-way air inlet valve 50 during the retraction stroke.

In the embodiment shown in FIGS. 9 to 13, the liquid pump 60, and first stage air pump 80, and the second stage air pump 82 are all in phase.

Although certain exemplary embodiments of the invention have been illustrated and described, the invention is not limited to these specific embodiments, and many modifications and variations will occur to those skilled in the art. For example, the pump 10 is not limited to piston-type constructions such as those shown in the exemplary embodiments. Rather, any suitable pump type that, when activated, generates an elevated internal pressure that is greater than atmospheric pressure, and passes air and a liquid through a foam generator at the elevated pressure to produce foam, could be used. For example, in alternative embodiments of the invention a diaphragm type pump could be used instead.

The invention is not limited to the particular constructions and proportions that have been shown. Depending on its intended use, various components of the pump 10 could have a different size, shape, or orientation than those shown in the preferred embodiments, or may be omitted altogether. For example, in some alternative embodiments of the invention, the one-way exit valve 52 could be positioned axially outwardly from the screen 54 rather than axially inwardly. When in this orientation, the one-way exit valve 52 would cause the pressure on both sides of the screen 54 to rise up to the threshold pressure when the first air compartment 70 is compressed. The valve 52 would then open and the air and liquid 104 would flow through the screen 54 towards the valve 52 at the threshold pressure, thus generating the first foam before passing through the valve 52.

The pump 10 could be adapted for manual activation and/or electronic activation, as desired. The pump 10 is not limited to any particular mode of activation and may, for example, be configured upon activation to perform the withdrawal stroke before the retraction stroke; the retraction stroke before the withdrawal stroke; or any other combination or order of complete and/or partial strokes in the cycle of operation.

The pump 10 is preferably configured to generate an elevated internal pressure under a range of expected operating conditions. For manually operated pumps 10, preferably a minimal amount of force is required to generate an elevated internal pressure of at least 0.5 bar above atmospheric pressure. Preferably, the first air compartment 70 has a relatively small volume and the pump 10 has a relatively long stroke length, to keep the force required to generate the elevated pressure at a manageable level. In the preferred embodiment shown in FIGS. 9 to 13, the inner chamber 21 has a diameter of 7.15 mm; the intermediate chamber 25 has a diameter of 9 mm, and the outer chamber 30 has a diameter of 29.5 mm. This results in a nominal 1 ml liquid dosage from the liquid pump 60, a 1.6 ml total high pressure dosage from the first stage air pump 80 at 1.5 bar, and a 15.5 ml final air dosage of foam with a 15.8 air to liquid ratio from the second stage air pump 82 with a 25 mm stroke. In other embodiments, the elevated pressure is at least 0.5 bar above atmospheric pressure, preferably at least 1.0 bar above atmospheric pressure, and more preferably at least 1.5 bar above atmospheric pressure. The elevated pressure is the pressure of the liquid 104 and the air as measured immediately before entering the first foam generator 404. Those skilled in the art will appreciate that, in some embodiments of the invention, the pressure of the liquid 104 and the air may decrease as the fluids move through the first foam generator 404.

The threshold pressure at which the high pressure valve 406 opens can be selected so that the liquid 104 and the air pass through the foam generator 404 at the desired elevated pressure. In some embodiments, the threshold pressure is at least 0.5 bar above atmospheric pressure, preferably at least 1.0 bar above atmospheric pressure, and more preferably at least 1.5 bar above atmospheric pressure.

The high pressure valve 406 may be provided in any form that is suitable for generating the elevated pressure, including but not limited to the diaphragm check valve 52 and the spring-loaded ball valve 270 as shown in the preferred embodiments. It will be appreciated by those skilled in the art that in at least some embodiments of the invention, the threshold pressure at which the high pressure valve 406 opens to allow fluid to flow therepast will depend on the pressure differential across the high pressure valve 406. Preferably, the high pressure valve 406 is configured to open when the pressure differential is greater than 0.5 bar in some embodiments, greater than 1.0 bar in other embodiments, greater than 1.0 atmosphere in still other embodiments, and greater than 1.5 bar in still further preferred embodiments. The high pressure valve 406 functions as a flow restrictor which restricts the flow of fluid through the foam generator 404, to thereby increase the pressure of the fluid. In some embodiments of the invention, the high pressure valve 406 could optionally be replaced with other types of flow restrictors, such as narrow passageways that restrict fluid flow to increase the fluid pressure, but which do not necessarily incorporate movable parts that have an open and a closed state.

The reduced pressure at which the first foam and the second volume of air are delivered to the second foam generator 412 is preferably lower than the elevated pressure at which the liquid 104 and the first volume of air are delivered to the first foam generator 404. Preferably, the reduced pressure is close to atmospheric pressure, and may for example be in the range of 0.05 to 0.1 bar above atmospheric pressure. The reduced pressure is preferably below 0.5 bar above atmospheric, and more preferably below 0.1 bar above atmospheric.

The invention also includes all methods and uses of the pumps 10 disclosed herein, whether explicitly described or implicit from the features and structures that have been described. For example, the invention includes a method of producing foam comprising activating a foam pump to generate an elevated internal pressure within the foam pump that is greater than atmospheric pressure, and passing air and a liquid through a foam generator at the elevated pressure to produce foam.

The liquid 104 that is used to generate the foam is preferably a foamable hand cleaning liquid, such as foam soap or alcofoam. Any suitable flowable and foamable substance could be used. The liquid reservoir 102 from which the liquid 104 is drawn is preferably provided in an unpressurized state in which the liquid 104 is contained at or around atmospheric pressure, or in some embodiments below atmospheric pressure. As used herein a hand cleaner includes hand sanitizers and disinfectants.

The air that is used to generate the foam is preferably drawn from an unpressurized air source that provides the air at or around atmospheric pressure, or in some embodiments below atmospheric pressure. Preferably, the air source is simply the external environment surrounding the pump 10 and from which atmospheric air is drawn into the pump 10 at atmospheric pressure, and is then compressed by the activation of the pump 10 to generate the elevated pressure. The elevated pressure is preferably generated through the mechanical action of the pump mechanism 402 rather than from a pre-pressurized source of air and/or liquid 104. Preferably, the air source and the liquid reservoir 102 each have a fluid pressure that is less than 0.5 bar above atmospheric pressure. The air may be drawn through any suitable pathway or pathways into the first air compartment 70 and the second air compartment 72. For example, air may be drawn into the first air compartment 70 directly from the atmosphere through a suitable valve and/or indirectly from the second air compartment 72 or another internal air source, which may receive the air from the discharge opening 108 and/or from another opening or valve. Air may likewise be drawn into the second air compartment 72 directly from the atmosphere through a suitable valve and/or indirectly from an internal air source, which may receive the air from the discharge opening 108 and/or from another opening or valve.

Although the preferred embodiments show the high pressure chamber 408 as containing and pressurizing both the liquid 104 and the air, this is not necessary. A person skilled in the art would appreciate, for example, that the high pressure chamber 408 could be configured to receive and contain only one fluid, the liquid 104 or the air, with the other fluid being contained in an unpressurized state within the high pressure passageway 238. Upon release of the first fluid from the high pressure chamber 408 into the high pressure passageway 238 at the threshold pressure, the high pressure passageway 238 would preferably be configured so that the influx of the first fluid would raise the pressure of the second fluid up to the elevated pressure. The first fluid and the second fluid would then pass through the foam generator 404 at the elevated pressure to generate foam.

The pump 10 preferably forms part of a hand cleaner or hand cleaner assembly which comprises the pump 10 and the reservoir 102, and which is provided to dispense a foamed mixture of a hand cleaning liquid 104 and air to the atmosphere at atmospheric pressure and unto a user's hand.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein. For a definition of the invention, reference is made to the following claims.

We claim:

1. A method of generating foam comprising:

delivering a liquid and a first volume of air through a first foam generator to generate a first foam; and delivering the first foam and a second volume of air through a second foam generator to generate a second foam; and regulating a flow of a fluid through the first foam generator using a high pressure valve;

wherein the high pressure valve prevents the fluid from flowing past the high pressure valve unless the fluid is at or above a threshold pressure;

wherein the liquid and the first volume of air are delivered through the first foam generator by a pump mechanism;

wherein the liquid and the first volume of air are pressurized up to at least the threshold pressure when the pump mechanism is activated; and wherein at least one of the liquid and the first volume of air are received by a variable volume high pressure compartment;

the method further comprising: reducing a volume of the variable volume pressure compartment from a first volume to a smaller second volume on activation of the pump mechanism, thereby increasing a pressure within the variable volume high pressure compartment up to at least the threshold pressure.

2. The method according to claim 1, wherein the high pressure valve comprises a one-way valve.

3. The method according to claim 1, wherein the threshold pressure is at least 0.5 bar above atmospheric pressure.

4. The method according to claim 1, wherein the threshold pressure is at least 1.5 bar above atmospheric pressure.

5. The method according to claim 1, wherein the liquid and the first volume of air are delivered to the first foam generator at a first pressure that is greater than atmospheric pressure.

6. The method according to claim 5, wherein the first foam and the second volume of air are delivered to the second foam generator at a second pressure that is lower than the first pressure.

7. The method according to claim 5, wherein the first pressure is at least 0.5 bar above the atmospheric pressure.

8. The method according to claim 5, wherein the first pressure is at least 1.5 bar above the atmospheric pressure.

9. The method according to claim 5, wherein the first pressure is in a range of 0.5 to 2.5 bar above the atmospheric pressure.

10. The method according to claim 1, wherein the pump mechanism draws the liquid from an unpressurized liquid reservoir; and wherein the pump mechanism draws the air from an unpressurized air source.

11. The method according to claim 10, wherein the method is performed using a foam dispenser; and wherein the unpressurized air source comprises an external environment surrounding the foam dispenser.

12. The method according to claim 10, wherein the pump mechanism is manually activated.

13. The method according to claim 1, wherein the first foam generator comprises a screen; and wherein the second foam generator comprises a porous member for generating turbulence when the air and the first foam pass simultaneously through the porous member.

14. The method according to claim 1, wherein the liquid comprises a hand cleaning liquid.

15. The method according to claim 1, wherein the high pressure valve comprises a one-way valve;

wherein the liquid and the first volume of air are delivered to the first foam generator at a first pressure that is greater than atmospheric pressure; and wherein the first foam and the second volume of air are delivered to the second foam generator at a second pressure that is lower than the first pressure.

16. The method according to claim 15, wherein the pump mechanism draws the liquid from an unpressurized liquid reservoir; and wherein the pump mechanism draws the air from an unpressurized air source.

17. The method according to claim 16, wherein the method is performed using a foam dispenser;

wherein the unpressurized air source comprises an external environment surrounding the foam dispenser; and wherein the pump mechanism is manually activated.

18. The method according to claim 17, wherein the first foam generator comprises a screen;

wherein the second foam generator comprises a porous member for generating turbulence when the air and the first foam pass simultaneously through the porous member;

wherein the liquid comprises a hand cleaning liquid; and wherein the first pressure is at least 0.5 bar above the atmospheric pressure.

19. The method according to claim 1, wherein the pump mechanism comprises a piston pump mechanism.

20. The method according to claim 19, wherein the high pressure valve is positioned between the variable volume high pressure compartment and the first foam generator;

wherein the piston pump mechanism further comprises a high pressure passageway that fluidly connects the high pressure valve to the first foam generator;

wherein the high pressure passageway delivers the liquid and the first volume of the air to the first foam generator at an elevated pressure that is greater than atmospheric pressure when at least one of the liquid and the air is received from the high pressure valve at the threshold pressure;

wherein the high pressure passageway receives the liquid and the first volume of the air through the high pressure valve from the variable volume high pressure compartment;

wherein the high pressure passageway has a volume that is selected so that an internal pressure within the high pressure passageway rises to the elevated pressure when the liquid and the air are received from the high pressure valve at the threshold pressure;

wherein the piston pump mechanism comprises a second variable volume compartment for receiving the first foam from the first foam generator, and delivering the first foam and the second volume of the air through the second foam generator to generate the second foam;

wherein the second variable volume compartment delivers the first foam and the second volume of the air to the second foam generator at a reduced pressure that is lower than the elevated pressure; and wherein the piston pump mechanism reduces a volume of the second variable volume compartment from an expanded volume to a reduced volume when activated, thereby delivering the first foam and the second volume of the air through the second foam generator.

* * * * *